US006721711B1

(12) United States Patent
Hoshiai

(10) Patent No.: US 6,721,711 B1
(45) Date of Patent: Apr. 13, 2004

(54) AUDIO WAVEFORM REPRODUCTION APPARATUS

(75) Inventor: Atsushi Hoshiai, Ozaki Hannan (JP)

(73) Assignee: Roland Corporation, Osaka (JP)

( * ) Notice: Subject to any disclaimer, the term of this patent is extended or adjusted under 35 U.S.C. 154(b) by 669 days.

(21) Appl. No.: 09/691,466

(22) Filed: Oct. 18, 2000

(51) Int. Cl.[7] ..... G10L 19/00
(52) U.S. Cl. ..... 704/500; 704/212; 704/278
(58) Field of Search ..... 704/200, 207, 704/212, 278, 500; 84/645

(56) References Cited

U.S. PATENT DOCUMENTS

| | | | | | |
|---|---|---|---|---|---|
| 3,946,504 | A | | 3/1976 | Nakano | 35/35 C |
| 4,805,217 | A | | 2/1989 | Morihiro et al. | 381/35 |
| 4,876,937 | A | | 10/1989 | Suzuki | 84/612 |
| 5,315,057 | A | | 5/1994 | Land et al. | 84/601 |
| 5,347,478 | A | | 9/1994 | Suzuki et al. | 364/715.02 |
| 5,350,882 | A | | 9/1994 | Koguchi et al. | |
| 5,412,152 | A | | 5/1995 | Kageyama et al. | 84/607 |
| 5,471,009 | A | | 11/1995 | Oba et al. | 84/645 |
| 5,499,316 | A | * | 3/1996 | Sudoh et al. | 704/270 |
| 5,511,000 | A | | 4/1996 | Kaloi et al. | 364/514 A |
| 5,511,053 | A | | 4/1996 | Jae-Chang | |
| 5,611,018 | A | * | 3/1997 | Tanaka et al. | 704/215 |
| 5,675,709 | A | * | 10/1997 | Chiba | 704/278 |
| 5,713,021 | A | | 1/1998 | Kondo et al. | 395/614 |
| 5,717,818 | A | | 2/1998 | Nejime et al. | 395/2.2 |
| 5,734,119 | A | | 3/1998 | France et al. | 84/622 |
| 5,745,650 | A | | 4/1998 | Otsuka et al. | 395/2.69 |
| 5,763,800 | A | | 6/1998 | Rossum et al. | 84/603 |
| 5,765,129 | A | | 6/1998 | Hyman et al. | 704/270 |
| 5,774,863 | A | * | 6/1998 | Okano et al. | 704/278 |
| 5,781,696 | A | * | 7/1998 | Oh et al. | 704/270 |
| 5,792,971 | A | | 8/1998 | Timis et al. | 84/609 |
| 5,809,454 | A | * | 9/1998 | Okada et al. | 704/214 |
| 5,847,303 | A | * | 12/1998 | Matsumoto | 84/610 |
| 5,873,059 | A | | 2/1999 | Iijima et al. | 704/207 |
| 5,886,278 | A | | 3/1999 | Yoshida | 84/604 |
| 5,952,596 | A | | 9/1999 | Kondo | |
| 5,973,255 | A | | 10/1999 | Tanji | |
| 6,169,240 | B1 | | 1/2001 | Suzuki | 84/605 |

OTHER PUBLICATIONS

Keith Lent, *An Efficient Method for Pitch Shifting Digitally Sampled Sounds,* Computer Music Journal, vol. 13, No. 4, Winter 1989, pp 65–71.

* cited by examiner

*Primary Examiner*—Doris H. To
*Assistant Examiner*—Michael N. Opsasnick
(74) *Attorney, Agent, or Firm*—Foley & Lardner

(57) ABSTRACT

The present invention relates to an audio waveform reproduction apparatus for reproducing a recorded audio waveform at a reproduction tempo that can be specified as desired, and its object is to achieve that the reproduction does not deviate from the tempo when performed at a tempo that is different from the tempo at the time of recording of the audio waveform. The audio waveform reproduction apparatus includes a storage means for storing waveform data of the audio waveform, an input means for inputting reproduction tempo information, a first information production means for producing first information (TP) that is a time function based on the reproduction tempo information, a second information production means for producing second information (PP) that is a time function based on time axis compression/expansion information (TR), a compression/expansion information production means for comparing the first information and the second information and calculating the time axis compression/expansion information (TR) towards matching the temporal change of the second information with the temporal change of the first information, and a time axis compression/expansion processing means for performing time axis compression/expansion processing based on the time axis compression/expansion information (TR) to produce a reproduction audio waveform, wherein the first information (TP) and the second information (PP) represent positions on a common axis.

31 Claims, 22 Drawing Sheets

*DATA STRUCTURE IN WAVEFORM MEMORY*

| |
|---|
| WAVEFORM-RELATED INFORMATION |
| ORIGINAL TEMPO |
| START ADDRESS<br>END ADDRESS |
| PCM WAVEFORM DATA STRING |

*ACTUATOR DETECTION PROCESS*
*(CPU INTERRUPT PROCESS 1)*

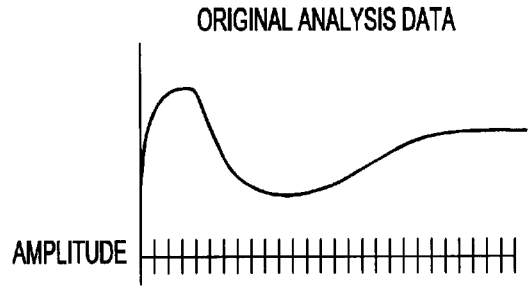
FIG. 22A
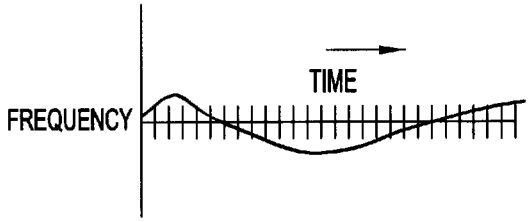
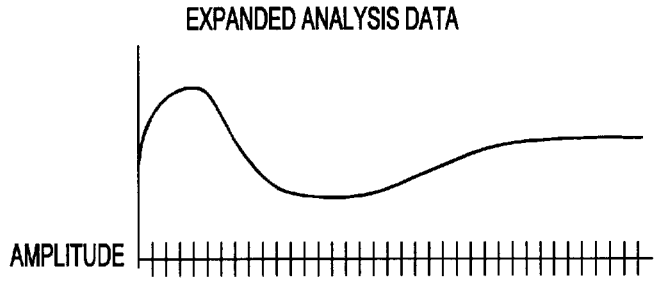
FIG. 22B
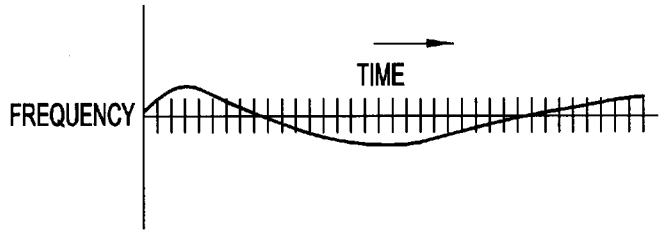
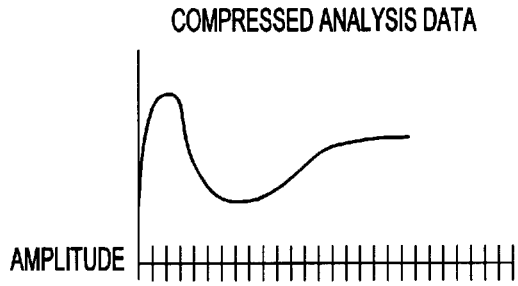
FIG. 22C
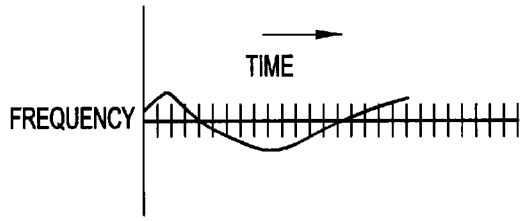

AUDIO WAVEFORM REPRODUCTION APPARATUS

CROSS-REFERENCE TO RELATED APPLICATIONS

Embodiments of the present invention claim priority from Japanese Patent Application Ser. No. H11-295247, filed Oct. 18, 1999, and Japanese Patent Application Ser. No. 2000-150040, filed May 22, 2000. The content of these applications are incorporated by reference herein.

BACKGROUND OF THE INVENTION

1. Field of the Invention

The present invention relates to an audio waveform reproduction apparatus for storing an audio waveform having its own tempo, for example, by sampling, and reproducing the audio waveform, changing the tempo to a reproduction tempo that can be specified as desired at the time of reproduction. The reproduction tempo can be tempo information that is input externally (for example, the timing clock, which is a system real-time message represented by F8 in the case of a MIDI signal) or internal tempo information specified inside the apparatus, and the apparatus can reproduce the waveform at a reproduction speed that corresponds to this tempo information.

2. Description of the Related Art

Conventionally, to reproduce sampled audio waveforms, several time axis compression/expansion techniques are known that change the reproduction speed without changing the pitch, and these time axis compression/expansion techniques are used to change the original tempo of the audio waveform (that is, the tempo at the time of the recording) to a desired tempo when reproducing the sampled audio waveform.

For example, in the invention disclosed in Publication of Unexamined Japanese Patent Application (Tokkai) H7-295589, to reproduce the sampled audio waveform with time axis compression/expansion so as to change the tempo at the time of recording to a desired reproduction tempo, the ratio of the original tempo of the audio waveform (that is, the tempo at the time of recording) and the tempo for reproduction is determined, and taking this ratio as the time axis compression/expansion amount, the audio waveform is compressed/expanded on the time axis, and the original audio waveform is reproduced at the reproduction speed of the reproduction tempo.

However, to reproduce the audio waveform with this method, first of all, the amount for the time axis compression/expansion processing is determined and set beforehand, and this amount for the time axis compression/expansion processing is sustained for the duration of the waveform reproduction. On the other hand, the tempo of music usually changes somewhat over the passage of time. Therefore, with the proceeding reproduction of the audio waveform, a discrepancy to the set tempo ratio occurs, which builds up, thus deviating from the tempo, so that it was difficult to reproduce an audio waveform that follows a change of the tempo over time. Neither was it possible to reproduce audio waveforms following a reproduction tempo when the reproduction speed was changed during the reproduction (for example, by changes due to speed indicators such as "ritardando" or "accelerando").

SUMMARY OF THE DISCLOSURE

With the foregoing in mind and in light of these problems, it is an object of the present invention to provide a device for reproducing recorded audio waveforms that does not deviate from the tempo when the reproduction is performed at a desired tempo that is different from the tempo at the time of recording.

Another object of the present invention is to provide a device for reproducing recorded audio waveforms that precisely follows temporal changes of the tempo, and, in particular, one that can precisely follow temporal changes of the tempo information in a realtime process.

In order to attain these objects, an audio waveform reproduction apparatus in accordance with the present invention includes (1) a storage means for storing waveform data representing an audio waveform, (2) a reproduction tempo information input means for inputting reproduction tempo information expressing a tempo for a time when the audio waveform is reproduced, (3) a first time function production means for producing first information (TP) that is a time function based on the reproduction tempo information, (4) a second time function production means for producing second information (PP) that is a time function based on time axis compression/expansion information (TR), (5) a time axis compression/expansion information production means for comparing the first information and the second information and calculating the time axis compression/expansion information (TR) towards matching the temporal change of the second information with the temporal change of the first information, and (6) a time axis compression/expansion processing means for subjecting the audio waveform to time axis compression/expansion processing based on the time axis compression/expansion information (TR) to produce a reproduction audio waveform. The first information (TP) and the second information (PP) represent positions on a common axis.

An audio waveform reproduction apparatus with this basic configuration produces time axis compression/expansion information precisely following temporal changes of the reproduction tempo at which the recorded audio waveform is reproduced, and subjects the recorded audio waveform to time axis compression/expansion processing in accordance with this time axis compression/expansion information, so that the audio waveform can be reproduced, precisely following temporal changes of the reproduction tempo information.

That is to say, waveform data representing the audio waveform and original tempo information, which is the tempo at the time of recording of the audio waveform, are stored beforehand in a memory means. Reproduction tempo information, which represents the tempo at the time of reproduction of the audio waveform, is input with a reproduction tempo information input means.

The first time function production means produces first information (TP) that is a time function of the reproduction tempo information, and the second time function production means produces second information (PP) that is a time function of time axis compression/expansion information (TR).

The time axis compression/expansion information production means compares the first information and the second information and calculates the time axis compression/expansion information (TR) towards matching the temporal change of the second information with the temporal change of the first information. By successively calculating the time axis compression/expansion information (TR) in this manner, the time axis compression/expansion processing means subjects the audio waveform to time axis compression/expansion processing based on the time axis compression/expansion information (TR) to reproduce the recorded audio waveform, precisely following the temporal changes of the reproduction tempo information.

It is preferable that in the audio waveform reproduction apparatus with this basic configuration, the waveform data of the storage means is PCM data, which is a time series of sampled amplitude data of the audio waveform, and that the time axis compression/expansion processing means subjects the PCM data to time axis compression/expansion processing based on the time axis compression/expansion information (TR) to produce the reproduction audio waveform.

In this configuration, it is preferable that the common axis represents positions of the PCM data in terms of addresses.

In this configuration of the audio waveform reproduction apparatus, it is preferable that the storage means also stores original tempo information, which is the tempo of the audio waveform at the time of recording, that the reproduction tempo information is period information of a period corresponding to the reproduction tempo, that the first time function production means calculates the amount of change of addresses per predetermined number of periods of reproduction tempo information, based on the original tempo information, and produces the first information, which is a time function representing positions of the PCM data, based on the amount of change of addresses and the reproduction tempo information.

In this configuration of the audio waveform reproduction apparatus, it is preferable that the first time function production means calculates the amount of change of addresses per one period of the reproduction tempo information and produces the first information (TP), which is a time function representing positions of the PCM data, which advance successively by the amount of change every time the reproduction tempo information is input, that the second time function production means produces the second information (PP), which is a time function representing positions of the PCM data, which advance successively by the time axis compression/expansion information (TR) for each reproduction sampling period, and that the time axis compression/expansion information production means compares the first information (TP) and the second information (PP) for each reproduction tempo information to calculate the time axis compression/expansion information (TR), which is the advance amount towards matching the first information with the second information.

In the aforementioned basic configuration of the audio waveform reproduction apparatus, it is preferable that the waveform data of the storage means is analysis data for analyzing and representing the audio waveform and that the time axis compression/expansion processing means subjects the analysis data to time axis compression/expansion processing based on the time axis compression/expansion information (TR) to produce the reproduction audio waveform.

In this configuration, it is preferable that the common axis represents positions in terms of virtual addresses representing the time axis of the audio waveform.

In this configuration of the audio waveform reproduction apparatus, it is preferable that the storage means also stores original tempo information, which is the tempo of the audio waveform at the time of recording, that wherein the reproduction tempo information is period information of periods corresponding to the reproduction tempo, and that the first time function production means calculates the amount of change of addresses per predetermined number of periods of reproduction tempo information, based on the original tempo information, and produces the first information, which is a time function representing positions in terms of the virtual addresses, based on the amount of change of addresses and the reproduction tempo information.

In this configuration of the audio waveform reproduction apparatus, it is preferable that the first time function production means calculates the amount of change of addresses per one period of the reproduction tempo information and produces the first information (TP), which is a time function representing positions in terms of the virtual addresses, which advance successively by the amount of change every time the reproduction tempo information is input, that the second time function production means produces the second information (PP), which is a time function representing positions in terms of the virtual addresses, which advance successively by the time axis compression/expansion information (TR) for each reproduction sampling period, and that the time axis compression/expansion information production means compares the first information (TP) and the second information (PP) for each reproduction tempo information to calculate the time axis compression/expansion information (TR), which is the advance amount towards matching the first information with the second information.

In this configuration of the audio waveform reproduction apparatus, it is preferable that the production of the audio waveform with the time axis compression/expansion processing means is repeated from the start position of the audio waveform, at a predetermined repetition period that is based on the reproduction tempo.

These and other objects, features, and advantages of embodiments of the invention will be apparent to those skilled in the art from the following detailed description of embodiments of the invention, when read with the drawings and appended claims.

BRIEF DESCRIPTION OF THE DRAWINGS

FIG. 22 illustrates the operation of the time axis compression/expansion processing means with the phase vocoder format in the other embodiment.

DETAILED DESCRIPTION OF PREFERRED EMBODIMENTS

In the following description of preferred embodiments, reference is made to the accompanying drawings which form a part hereof, and in which is shown by way of illustration specific embodiments in which the invention may be practiced. It is to be understood that other embodiments may be utilized and structural changes may be made without departing from the scope of the preferred embodiments of the present invention.

The following is a description of the preferred embodiments of the present invention, with reference to the accompanying drawings.

Figure 1:
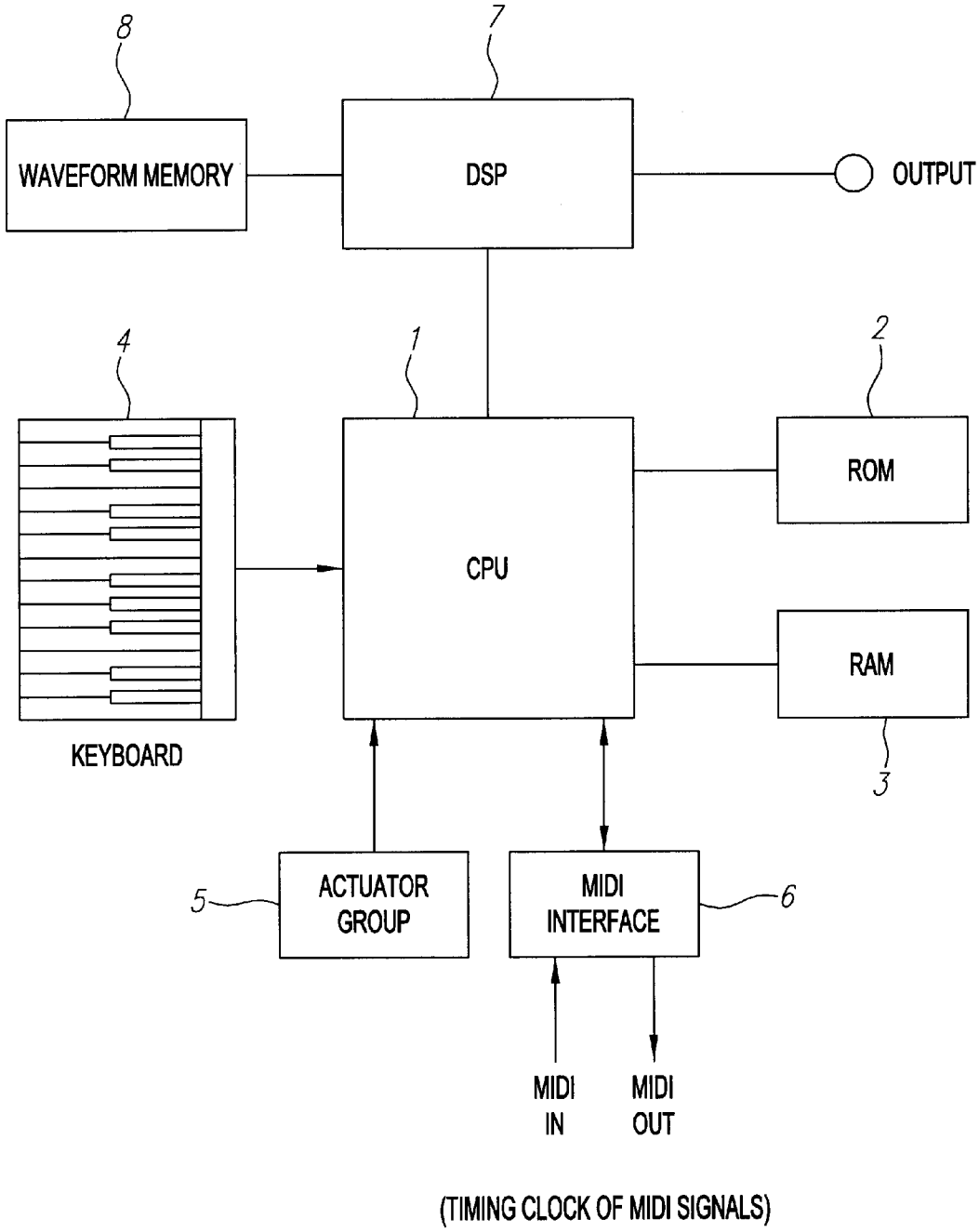
FIG. 1 shows the entire configuration of an electronic instrument on which an audio waveform reproduction apparatus has been implemented as an embodiment of the present invention.

FIG. 1 shows an audio waveform reproduction apparatus in an embodiment of the present invention. In this embodiment, an apparatus in accordance with the present invention is implemented in an electronic instrument having a keyboard.

In FIG. 1, CPU 1 is a central processing unit, which operates following the instructions of a control program stored in a ROM 2, and performs the control of the entire apparatus. For example, it detects the actuation statuses of a keyboard 4 and an actuator group 5 (which will be explained below) and controls a MIDI interface 6, a DSP 7, etc. The ROM 2 is a read only memory and stores the control program for the CPU 1 and the DSP 7. The control program for the DSP 7 is transferred to the DSP 7 via the CPU 1. The RAM 3 is a random access memory and serves as a working memory used by processes of the CPU 1. It can also store a plurality of waveform data sets of audio waveforms that have already been sampled.

Numeral 4 denotes a keyboard, which is usually used for inputting rendition information, such as when the user performs a rendition actuation. When an audio waveform reproduction is performed in accordance with the present invention, the waveform reproduction (begin of a sound generation) is indicated by pressing one of the keys of the keyboard 4 (key on), and the end of the waveform reproduction (end of sound generation) is indicated by releasing all keys (key off). The note number of the pressed key (when a plurality of keys are pressed, the note number with the highest pitch) serves as the pitch information of the audio waveform to be reproduced.

Numeral 5 denotes an actuator group, which includes several kinds of actuators for performing several kinds of settings. In the apparatus in accordance with the present invention, these are, for example, a tempo setting actuator for setting the reproduction tempo (tempo at the time of reproduction), a rendition tempo selection switch for selecting whether the tempo clock generated depending on the reproduction tempo is generated internally according to the tempo setting actuator or input externally, for example, with a MIDI signal, and an audio waveform selection switch for selecting the waveform data in the RAM 3 to be reproduced. The actuator group 5 also includes a display for displaying the status of the settings.

Numeral 6 is a MIDI interface, serving as an interface for inputting and outputting MIDI signals. In this embodiment, the timing clock of the MIDI signals is input externally via the MIDI interface 6 as tempo information.

The waveform memory 8 is a RAM and stores PCM waveform data strings, which have been produced by sampling (PCM recording) audio waveforms of instruments or vocals, as waveform data for reproduction. These audio waveforms consist of continuous pieces of music (phrases)

that are rendered with a certain tempo (namely, the original tempo). The waveform data of the desired waveform, which the user has selected with the audio waveform switch, is transferred from the waveform memory 8 to the RAM 3 and stored there.

Figures 3, 4:
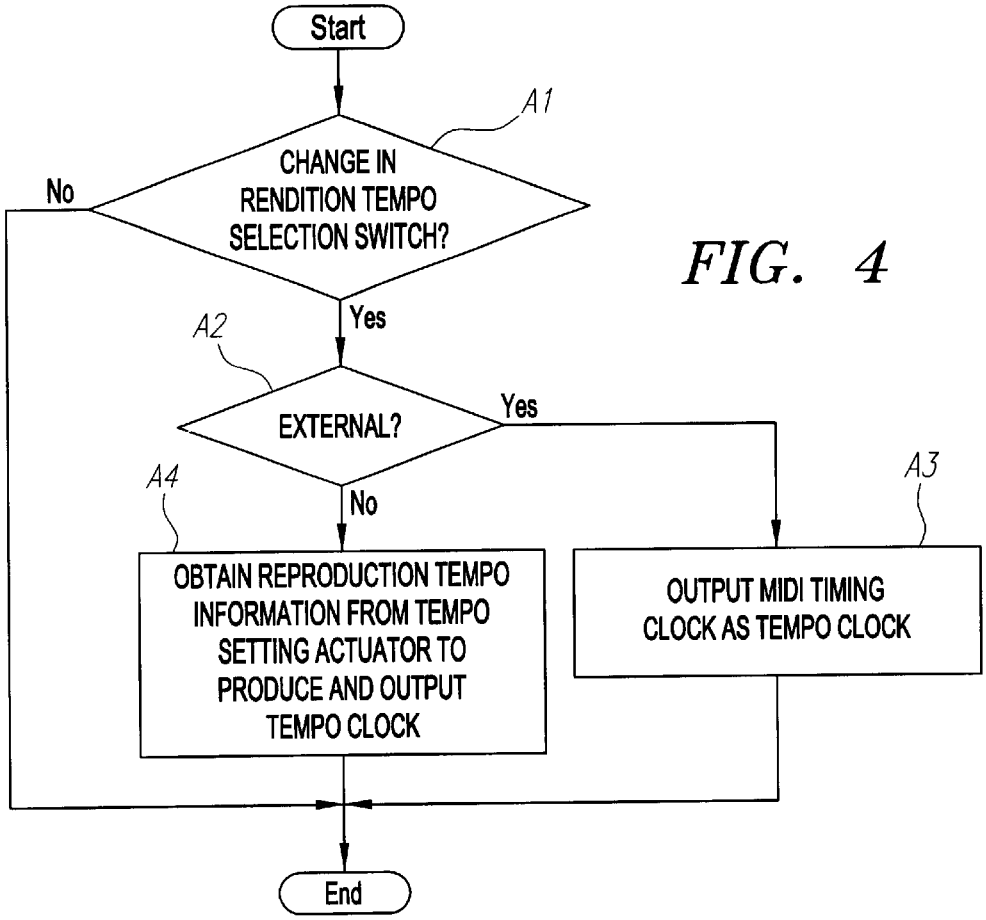
FIG. 3 shows the data structure of the waveform data stored in the waveform memory in an embodiment of an apparatus of the present invention.
FIG. 4 is a flowchart of the actuator detection process routine executed by the CPU in an embodiment of an apparatus of the present invention.

FIG. 3 shows the data structure of the waveform data stored in the waveform memory 8. As shown in this drawing, information belonging to a waveform, such as waveform-related information, original tempo, start address, and end address, is stored as waveform data for each audio waveform, together with the PCM data string serving as the waveform data itself.

The "original tempo" is the original tempo of the sampled audio waveform (that is, the tempo when reproduced with the same speed as the sampling speed). The sampling of the original audio waveform is performed by PCM recording at a sampling frequency of 44.1 kHz. The amplitude values (momentary values) of all sampling points are obtained successively as PCM waveform data, and this time series forms a PCM waveform data string. The individual PCM waveform data of this PCM waveform data string are provided sequentially with addresses (referred to as "waveform addresses" in the following) and stored as PCM waveform data strings in the waveform memory 8. Consequently, the time series of the waveform addresses (that is, the time series of the sampling points) forms the time axis of the audio waveform.

The start address is the address of the first data in the PCM waveform data string, and the end address is the address of the last data. Examples of waveform-related information are segment begin addresses (sadrs 1, sadrs 2, . . . ) and pitch data (spitch 0, spitch 1, . . . ), used for compression or expansion of the time axis with the method explained below. These are explained in detail in the course of the explanation of compression and expansion of the time axis.

The DSP 7 is a digital signal processor performing arithmetic processing for reproducing audio waveforms based on waveform data stored in the waveform memory 8. The DSP 7 is supplied by the CPU 1 with pitch information, a key flag "Key Flg" (key on/off information), and a tempo clock (tempo information determining the reproduction speed). In this embodiment, the processing of the pitch information is not directly related to the present invention, so that further explanations thereof have been omitted.

Figure 2:
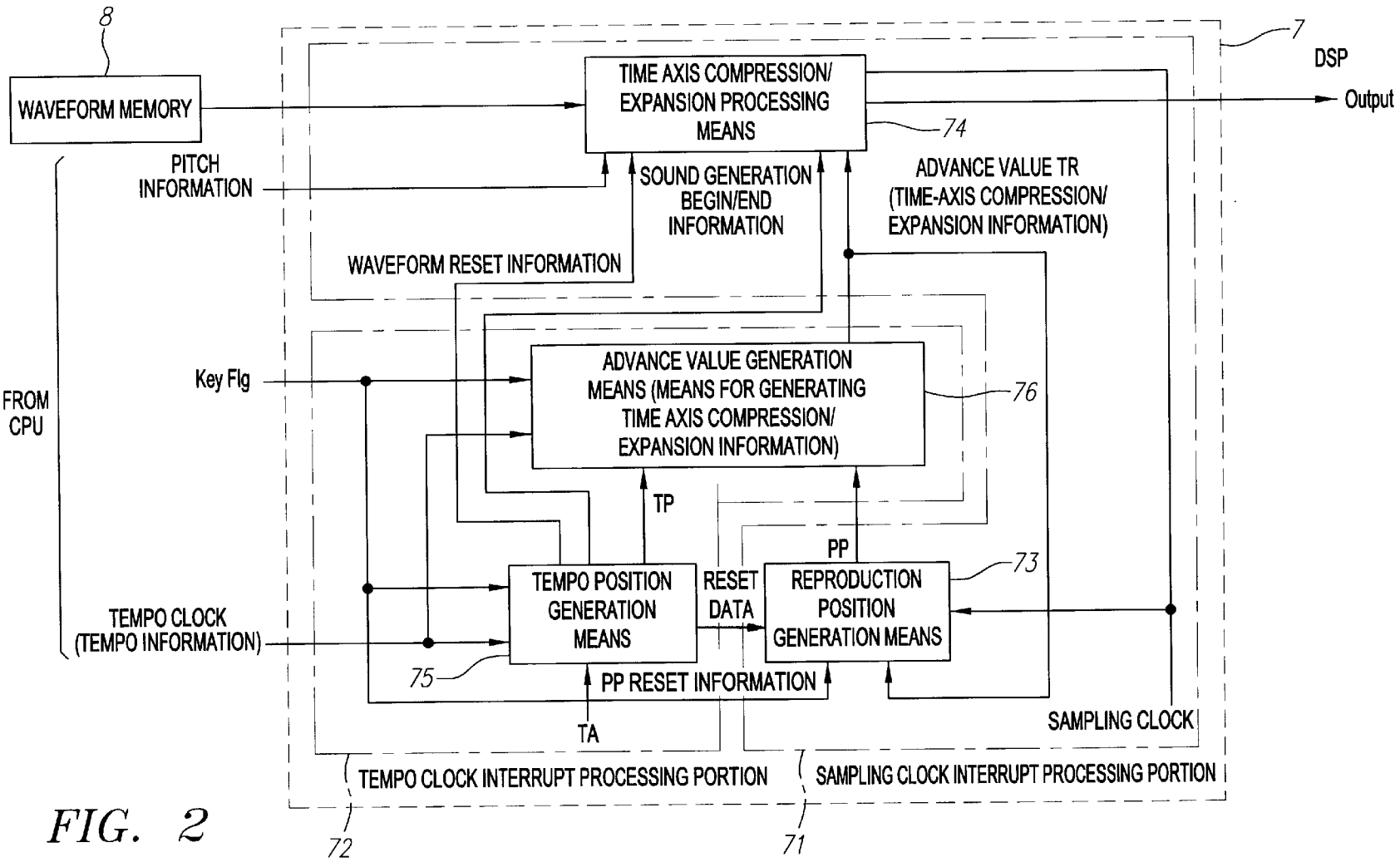
FIG. 2 shows an outline of configuration the DSP in the apparatus in an embodiment of the present invention as functional blocks.

FIG. 2 shows a structural outline of the DSP 7 in the form of functional blocks. As shown in the drawing, the DSP 7 is broadly made up of a sampling clock interrupt processing portion 71 and a tempo clock interrupt processing portion 72. The sampling clock interrupt processing portion 71 includes a reproduction position generation means 73 and a time axis compression/expansion processing means 74. The tempo clock interrupt processing portion 72 includes a tempo position generation means 75 and an advance value generation means (means for generating time axis compression/expansion information) 76.

In this configuration, the tempo position generation means 75 generates a tempo position TP from the tempo address length TA and the tempo clock supplied as reproduction tempo information by the CPU 1, the reproduction position generation means 73 generates a reproduction position PP (that is, a reproduction position address of the PCM waveform data string) from the sampling clock and the advance value TR, and the advance value generation means 76 generates an advance value TR from the tempo clock, the tempo position TP, and the reproduction position PP, etc. The time axis compression/expansion processing means 74 reproduces and outputs the PCM waveform data string of the waveform memory 8 while performing time axis compression/expansion processing based on the advance value TR. All these parameters are explained in detail below.

With this configuration, the time axis compression/expansion processing means 74 is controlled by the advance value TR (that is, the time axis compression/expansion information) produced in accordance with the tempo clock supplied by the CPU 1, which is a main point of the present invention.

The following explains how the apparatus of the present embodiment operates, with reference to a flowchart.

First, an outline of the operation is explained. The CPU 1 monitors the actuation status of the actuator group 5, and depending on how the rendition tempo selection switch in the actuator group 5 is set, the tempo clock for reproduction is generated internally or generated externally with a timing clock of a MIDI signal coming from the outside, and based on the result of this selection, the tempo clock is generated and supplied to the DSP 7.

Moreover, to instruct the begin or the end of a waveform reproduction, the key-press/key-release status of the keyboard 4 is detected, and when a key is pressed or when the keys are released (that is, when all keys have been released), this key-on/off information is transferred to the DSP 7 in the form of a key flag "Key Flg" explained below.

The DSP 7 calculates the tempo address length TA, the tempo position TP, and the advance value TR and, based on these, successively produces the read-out addresses for reading out the PCM waveform data from the waveform memory 8, successively reads out the PCM waveform data at these read-out addresses, and reproduces the audio waveform.

Figure 8:
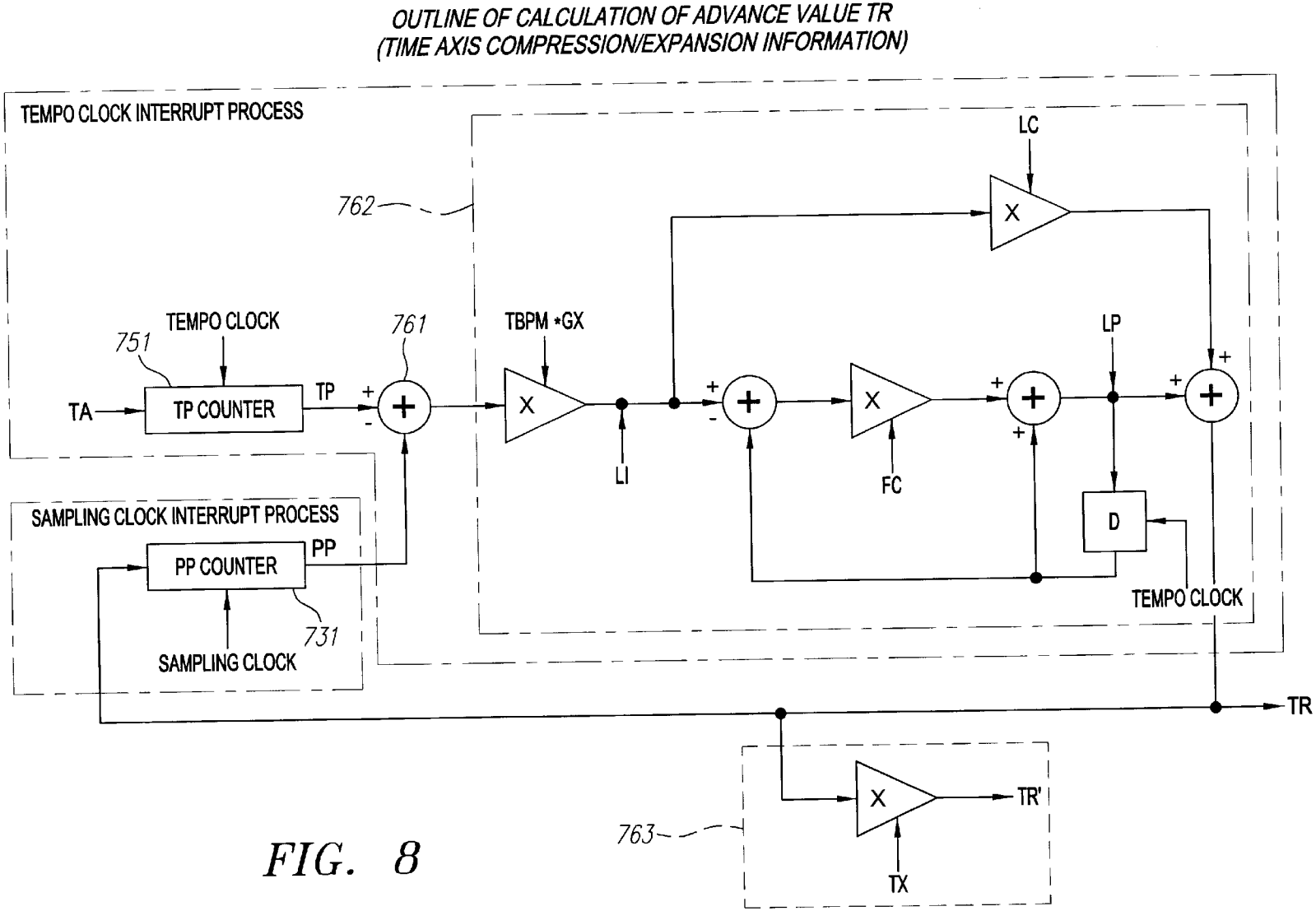
FIG. 8 shows, as functional blocks, an outline of the configuration of the advance value (time axis compression/expansion information) generation means in the DSP in an embodiment of an apparatus of the present invention.

FIG. 8 shows an outline of the arithmetic processing of the advance value TR (that is, the time axis compression/expansion information) performed by the DSP 7 in the form of functional blocks. As shown in the drawing, the functional blocks include a tempo position counter 751 for counting tempo positions TP, a reproduction position counter 731 for counting reproduction positions PP, a subtractor 761 for determining the difference between the tempo position TP and the reproduction position PP, a loop filter 762 for producing the advance value TR, and an advance value correction portion 763 for producing a corrected advance value TR' corresponding to a compressed or expanded advance value TR. Regarding the reproduction position counter 731 in the block diagram of FIG. 8 as a variable oscillator, it can be seen that this arrangement behaves like a PLL (phase-locked loop) in which the reproduction position counter 731 is synchronized with the tempo position counter 751.

Here, the reproduction positions PP are indicated by read-out addresses for reproducing (reading out) PCM waveform data on the time axis of the audio waveform (that is, the time series of the waveform addresses). The update period of the reproduction position addresses is the same as the sampling period, which is the period corresponding to the sampling frequency of 44.1 kHz. The aforementioned tempo address length TA is the length, in terms of waveform addresses, of one period of the tempo clock corresponding to the original tempo of the audio waveform. The tempo position TP is the reproduction position change, in terms of waveform addresses, following the tempo clock corresponding to the reproduction tempo on the time axis of the audio waveform. The advance value TR is the amount that the reproduction position PP (that is, the reproduction position address) is advanced per sampling period. In the apparatus of this embodiment, the original audio waveform, which has its own original tempo, can be reproduced with the reproduction tempo by correcting/updating the advance value TR successively (per period generated by the tempo clock) by feedback control.

The following is a more detailed explanation of the apparatus of this embodiment. First, the various processes performed by the CPU 1 are explained.

FIG. 4 is a flowchart of the actuator detection process performed by the CPU 1. This actuator detection process is performed periodically by an interrupt process and detects the actuation status of the actuators in the actuator group 6. This interrupt is generated periodically with a suitable period that is longer than the sampling period and shorter than the shortest period obtained by the timing clock. It should be noted that FIG. 4 presents only the actuators of relevance to the present invention.

When there is an interrupt, it is first determined whether there is a change in the rendition tempo selection switch (step A1). This rendition tempo selection switch is for selecting whether the tempo clock used for reproduction is generated internally or input externally. If the rendition tempo selection switch has been activated, it is determined whether external input has been selected (step A2).

In the case of external input, the rendition tempo at the time of reproduction (that is, the reproduction tempo) is obtained from the outside (the timing clock of the MIDI signal), so that the internal tempo clock generation process is stopped; and an external input tempo clock generation process is performed, setting an operation mode which generates a tempo clock each time the timing clock of the MIDI signal is input from the outside and supplying it to the DSP 7 (step A3).

On the other hand, if internal generation has been selected with the rendition tempo selection switch, the external input tempo clock generation process is stopped, and the internal tempo clock generation process is executed, whereby an operation mode is set, in which the setting status of the "tempo setting actuator" in the actuator group 5 is detected periodically, and a tempo clock depending on this setting status is generated internally and supplied to the DSP 7 (step A4).

Figure 5:
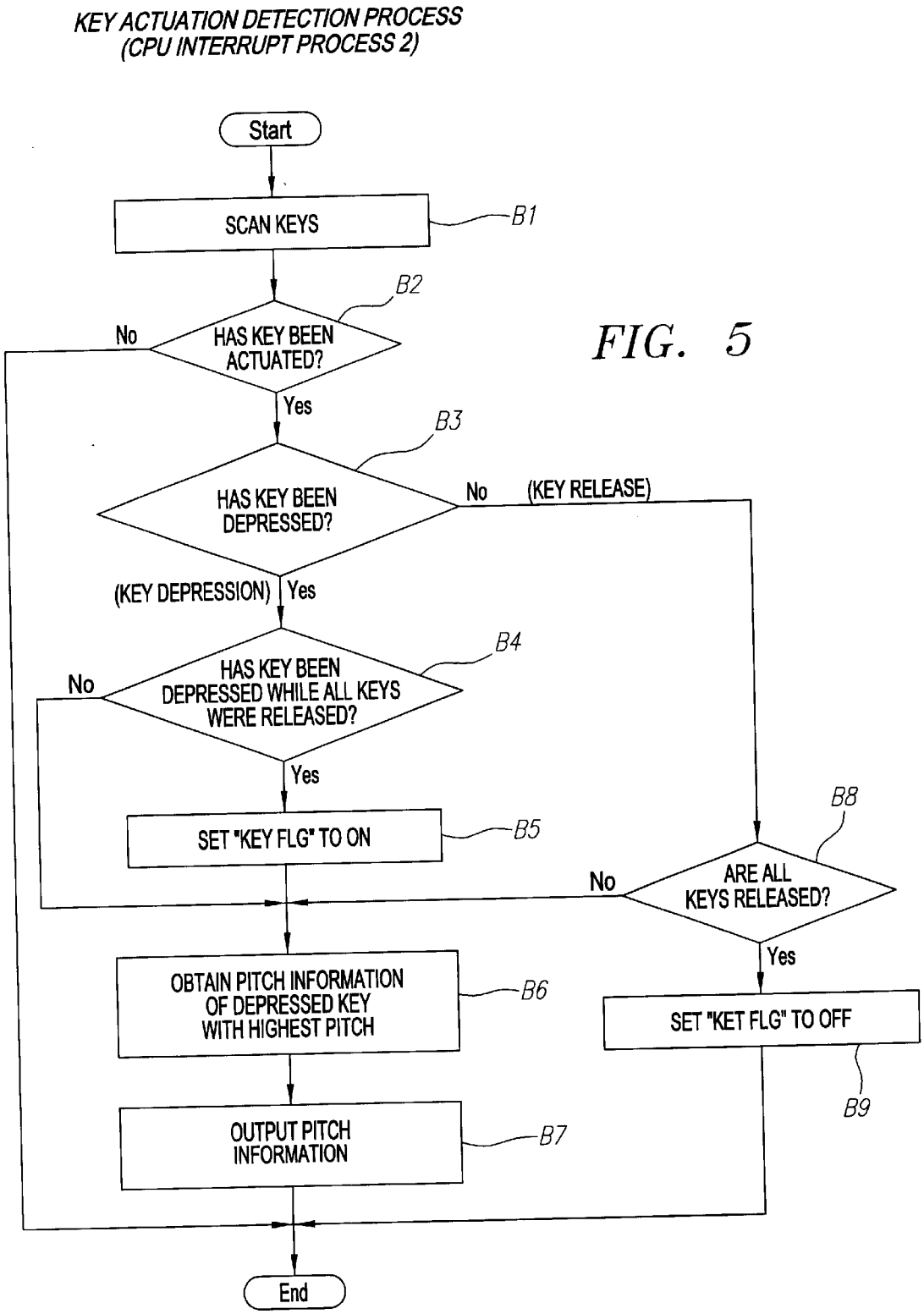
FIG. 5 is a flowchart of the key detection process routine executed by the CPU in an embodiment of an apparatus of the present invention.

FIG. 5 is a flowchart of the key actuation detection process executed by the CPU 1. Like the actuator detection process in FIG. 4, this key actuation detection process is executed periodically by an interrupt, detects the actuation status of the keys of the keyboard 4, and sets the key flag "Key Flg" on or off depending on the key-on or key-off of the keys. Here, a key-on is given when at least one of the keys of the keyboard 4 is pressed, whereas all keys have to be released for a key-off. Moreover, when a plurality of keys are key-on, the key-on of the key with the highest pitch is taken as the pitch information.

When an interrupt occurs, the key actuation status (key pressed or key released) of each of the keys of the keyboard 4 is scanned (step B1), and it is determined whether a key of the keyboard 4 has been newly actuated (step B2). If there is no key actuation (i.e., if there is no change over the prior scanned status), the key actuation detection process is terminated right away.

If there is a new key actuation, it is determined whether a key has been pressed (key-press actuation) or released (key-release actuation) (step B3). In case of a key-press actuation, it is determined whether a key has been pressed while all keys were released or whether one of the keys already had been pressed (step B4). If a key is pressed while all keys were released (that is, when not even one other key had been pressed), the key flag "Key Flg" is set to ON, which indicates that a sound is being generated (step B5), and the pitch information of the pressed key is obtained (step B6). On the other hand, if one or more keys had already been pressed, the pitch information with the highest pitch of the pressed keys is obtained and output to the DSP 7 (step B7).

If a key-release actuation is determined at step B3, it is determined whether this key-release actuation has resulted in the release of all keys (step B8). If it has not resulted in the release of all keys, that is, if at least one or more keys are still depressed, the pitch information with the highest pitch of the pressed keys is obtained and output to the DSP 7 (step B7). If it has resulted in the release of all keys, the key flag "Key Flg" is set to OFF, which indicates that no sound is being generated (step B9).

The following are explanations of the tempo address length TA, the tempo position TP, and the reproduction position PP.

Tempo Address Length TA

Figure 9:
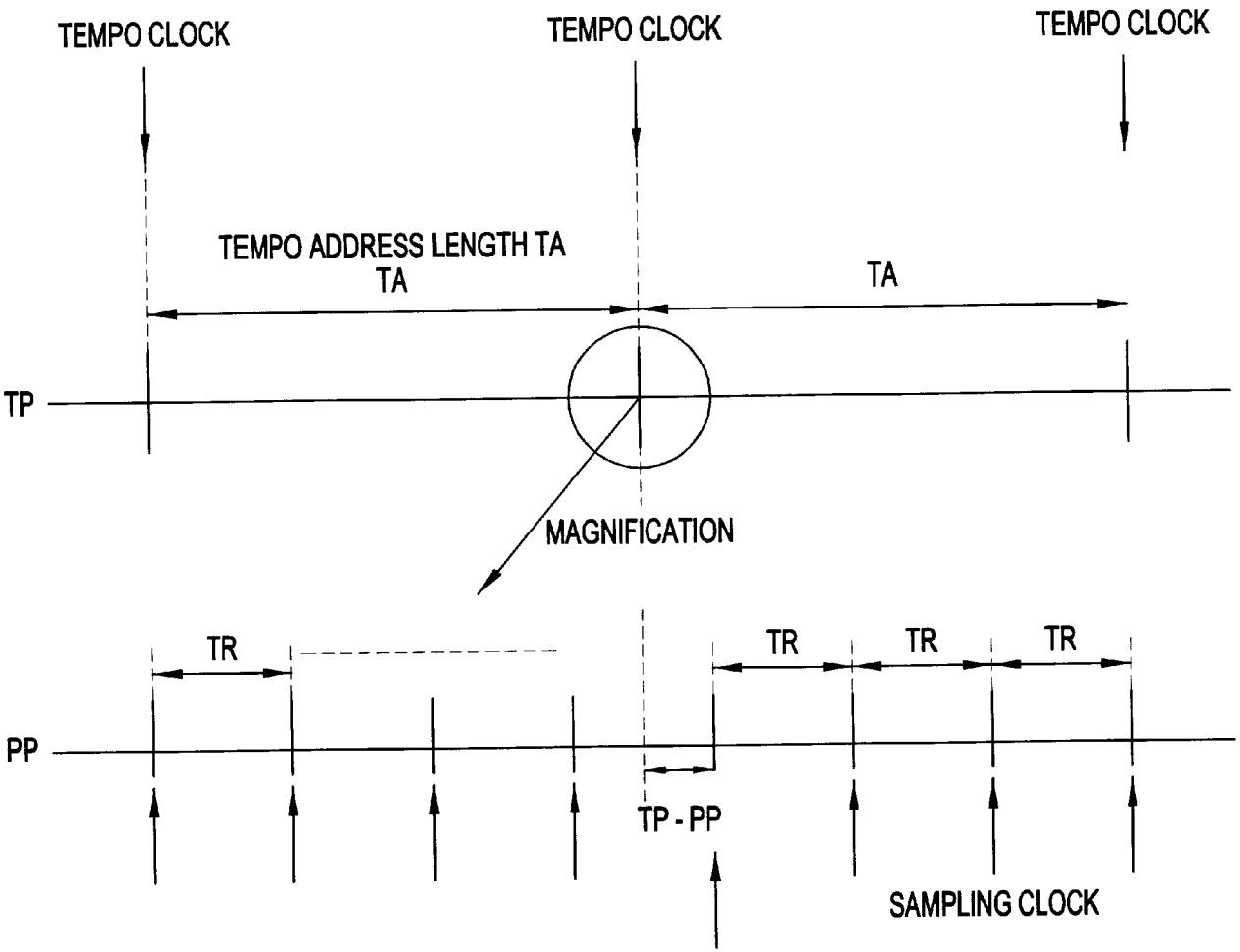
FIG. 9 illustrates the concepts of tempo length, tempo clock, reproduction position, etc., in an embodiment of an apparatus of the present invention.

First of all, the tempo address length TA represents the period of the tempo clock corresponding to the former tempo of the original audio waveform (original tempo) in terms of address numbers of that waveform (that is, the number of sampling points). FIG. 9 illustrates this concept. Based on the original tempo read in from the waveform memory 8, first the tempo address length TA, which is equivalent to the time of one tempo clock period of the original tempo, is calculated.

For example, if the original tempo of the original audio waveform is 120 bpm (beats per minute), and 24 tempo clocks are generated per quarter note, then the time of one period of the tempo clock is $$(60/120)/24=0.0208333 \text{ (sec)}.$$

Since the sampling frequency is 44.1 kHz, the tempo address length TA corresponds to $$44100\times0.0208333=918.75$$

samplings (that is, waveform addresses).

Tempo Position TP

Figure 10:
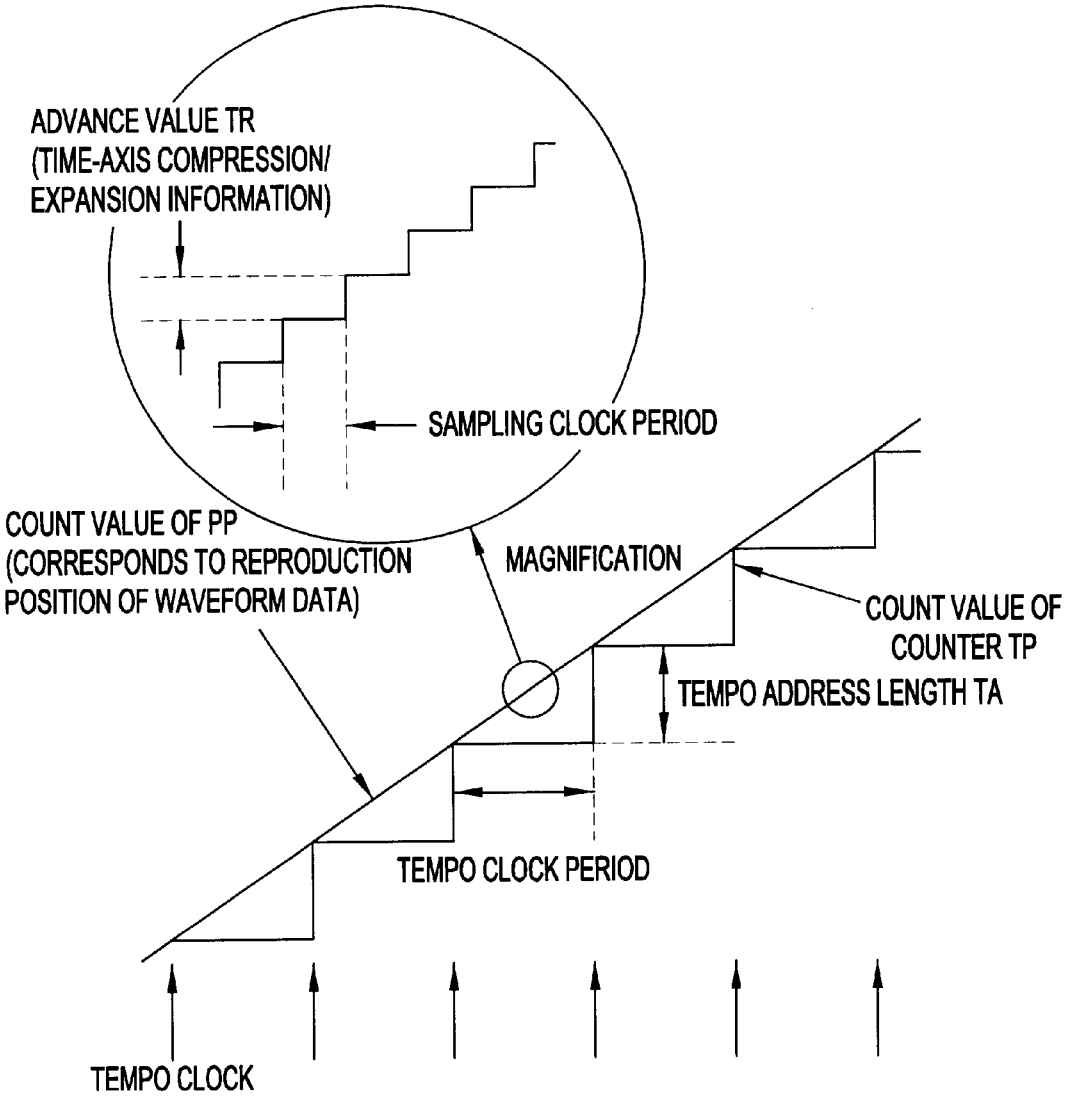
FIG. 10 illustrates the relation between the reproduction position PP, which is updated at each sampling clock and the tempo position TP, which is updated at each tempo clock, in an embodiment of an apparatus of the present invention.

The tempo position TP indicates the targeted change of the reproduction position and is the parameter showing at each tempo clock the reproduction position (position in terms of waveform addresses) on the time axis of the audio waveform. After the audio waveform has been started to reproduce following the tempo clock, this tempo position TP is increased by the tempo address length TA at each generation of a tempo clock based on the reproduction tempo. FIG. 10 shows how this tempo position TP is increased at each tempo clock.

Reproduction Position PP

The reproduction position PP is the parameter indicating the position on the time axis of the audio waveform (that is, the address of the waveform memory 8) at which the PCM waveform data are being read out and reproduced. As shown in FIG. 10, this reproduction position PP is calculated so that it increases by the advance value TR (which is equivalent to the time axis compression/expansion information) at each period of the sampling frequency of the waveform (44.1 kHz). This advance value TR is corrected and updated depending on the reproduction tempo at each generation period of the tempo clock, such that the audio waveform is reproduced changing its original tempo to the reproduction tempo. This will be explained in more detail below.

The following is a more detailed explanation of the various processes performed by the DSP 7.

The DSP 7 performs a tempo clock interrupt process (see FIG. 6), which is executed each time a tempo clock is input from the CPU 1, and a sampling clock interrupt process (see FIG. 7), which is executed at each generation period of the sampling clock.

Figure 6:
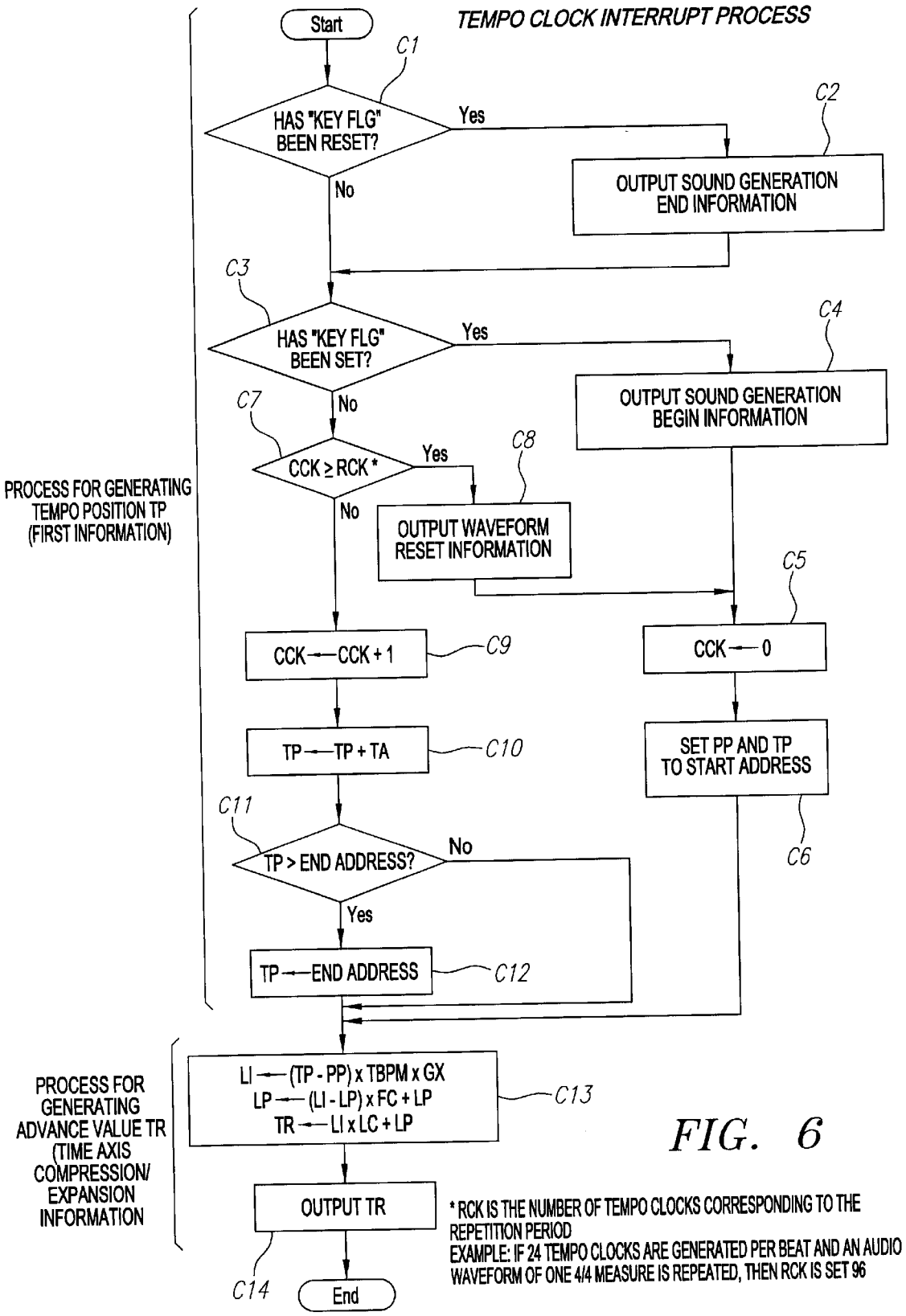
FIG. 6 is a flowchart of the tempo clock interrupt process routine executed by the DSP in an embodiment of an apparatus of the present invention.

FIG. 6 is a flowchart showing the steps of the tempo clock interrupt process. Every time a tempo clock is being input, this tempo clock interrupt process calculates the advance value TR for successively advancing the reproduction position PP, and updates the tempo position TP. Moreover, the instructions "begin sound generation" and "end sound generation" are generated in accordance with the key actuation status of the keyboard 4, and a waveform reset signal is produced.

This waveform reset signal is for reproducing the audio waveform repeatedly in units of a certain length (namely, the repeat period Rck explained below, which is expressed in tempo clocks), and when the audio waveform has been reproduced from its start to a length of its repeat period Rck, a waveform reset signal is produced, so that the reproduction position PP returns to the start of the audio waveform. If, for example, 24 tempo clocks are generated per beat and an audio waveform of one 4/4 measure is repeated, then the repeat period Rck is set to 24×4=96. In the flow chart of FIG. 6, to perform this process, a tempo clock counter Cck is provided as a parameter for counting the number of input tempo clocks.

When there is an input of a tempo clock in the tempo clock interrupt process in FIG. 6, this process routine is triggered by an interrupt. First, it is determined whether the key-flag "Key Flg" has been reset, that is, whether the key-flag "Key Flg" has just been set to OFF (step C1). If the result of step C1 is "YES", that is, if it has just been set to OFF, then a sound generation end instruction is produced and supplied to the time axis compression/expansion processing means 74 (step C2). This sound generation end instruction ends the reproduction of the audio waveform currently being generated.

If, on the other hand, the result of step C1 is "NO", that is, if the key-flag "Key Flg" has not just been set to OFF, then it is determined whether the key-flag "Key Flg" has been set, that is, whether the key-flag "Key Flg" has just been set to ON (step C3). If the result of step C3 is "YES", that is, if it has just been set to ON, then a sound generation begin instruction is produced and supplied to the time axis compression/expansion processing means 74 (step C4). This sound generation begin instruction begins the reproduction of an audio waveform from its start position, as will be explained below.

Thus, by determining whether the key flag "Key Flg", which is synchronized with the tempo clock, is set or reset, the instructions "begin sound generation" and "end sound generation" are given to the time axis compression/expansion processing means 74 in synchronization with the tempo clock. Consequently, the begin and the end of the sound generation of the audio waveform can be performed in synchronization with the tempo clock.

If, on the other hand, the result of step C3 is "NO", that is, if the key-flag "Key Flg" has not just been set to ON, then this means that currently an audio waveform is being reproduced or a sound generation is being ended. In these cases, it is determined whether the tempo clock counter Cck, which counts the tempo clocks, is equal or larger than the abovementioned predetermined repeat period Rck, that is, whether $$Cck \geqq Rck \text{ (step C7)}.$$

If the decision at step C7 is "YES", then this means that the reproduction of the audio waveform has reached the reproduction position indicated by the repeat period Rck, so that to return the reproduction position of the audio waveform to the start position, a waveform reset signal is produced and output to the time axis compression/expansion processing means 74 (step C8), the tempo clock counter Cck is reset to zero, and the reproduction position PP and the tempo position TP are set to the start address, which is the start position of the audio waveform (step C6). Thus, the audio waveform is reproduced after its reproduction position has been returned to the start position.

As for the process after step C7, the same process is performed during reproduction as when the sound generation has been ended. When the sound generation has been ended, the process after step C7 has no influence, because the sound generation is ended after outputting the sound generation end information to the time axis compression/expansion processing means.

On the other hand, if the decision at step C7 is "NO", then this means that the reproduction of the audio waveform has not reached the reproduction position indicated by the repeat period Rck, so that in this case the reproduction of the audio waveform proceeds continuously from the current reproduction position, the tempo clock counter Cck is incremented by one in response to the present input of the tempo clock (step C9), and the tempo position TP is updated by adding the tempo address length TA (step C10).

Then, it is determined whether, as a result of updating the tempo position TP, the tempo position TP has exceeded the end address, which is the final position of the audio waveform (step C11). If it has exceeded the end address, the present tempo position TP is taken as the end address, because the reproduction position cannot be advanced beyond this end address, so that the reproduction position is not advanced beyond this tempo position (=end address) (step C12).

While it is not specifically noted in FIG. 6, it should be noted that it is also possible to perform the reproduction without this repeat reproduction by jumping from step C3 to step C9, whereby the decision at step C7 is obviated.

Subsequently, the advance value TR is updated. The advance value TR is corrected and updated to a value where the difference between the reproduction position PP, which is updated by the advance value TR at each sampling period, and the tempo position TP, which is updated at each tempo clock period, as shown in FIG. 10, is cancelled at the time when a tempo clock is being generated.

To be specific, the advance value TR is obtained by passing the difference (TP−PP) between the tempo position TP and the reproduction position PP through the loop filter 762 in FIG. 8, which performs the following calculation:

$$LI \leftarrow (TP-PP) \times TBPM \times GX$$

$$LP \leftarrow (LI-LP) \times FC + LP$$

$$TR \leftarrow LI \times LC + LP$$

wherein

TBPM is the value of the original tempo,

GX is the adjusted value of the loop gain, for example, $GX=100/2^{20}$,

LI is the input value of the loop filter,

FC is the coefficient determining the cutoff frequency of the loop filter, for example, FC=0.125, LC is the coefficient determining the minimum gain of the loop filter, for example, LC=0.125, and LP is the low-pass component of the loop filter.

Figure 7:
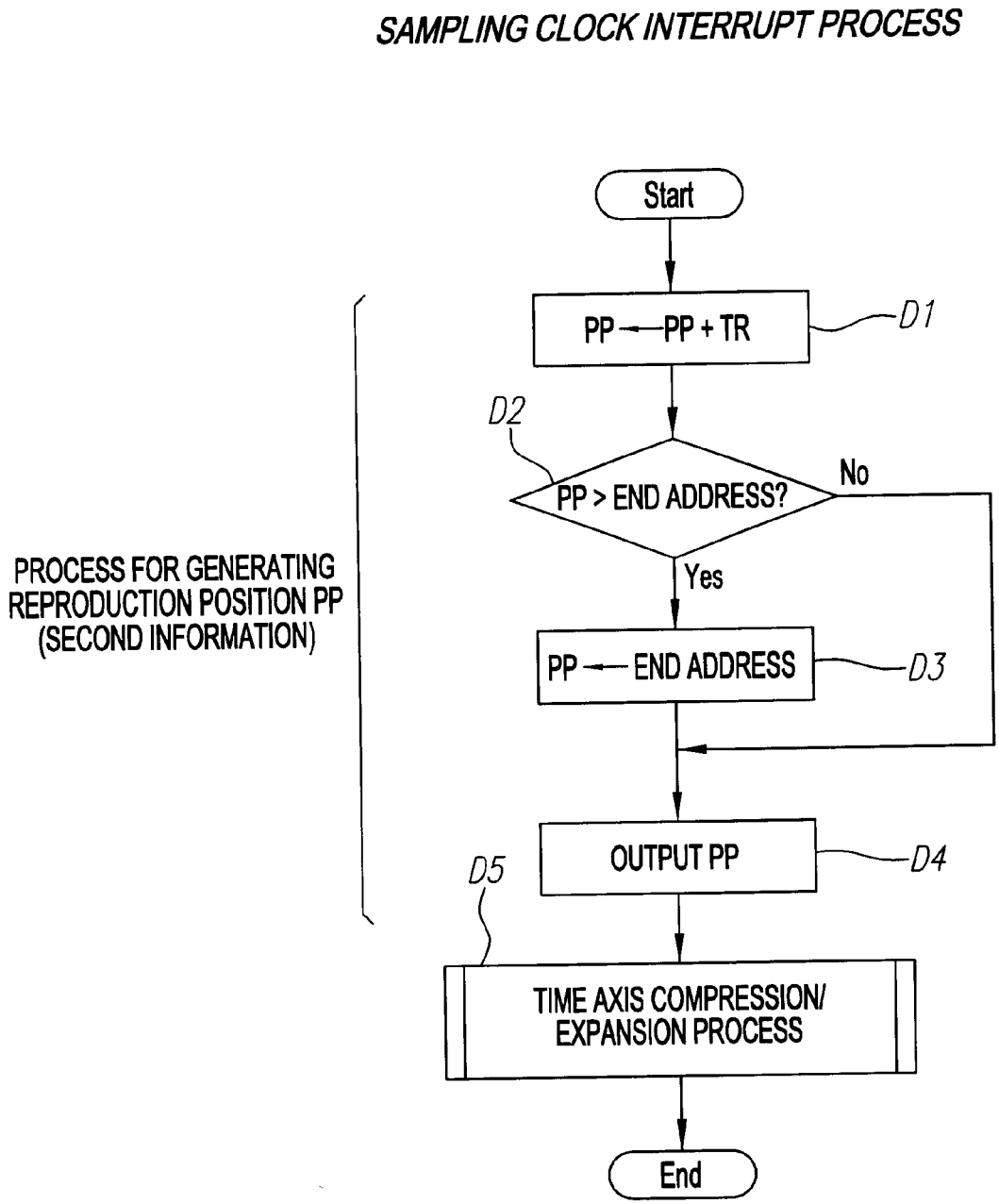
FIG. 7 is a flowchart showing the sampling clock interrupt process routine executed by the DSP in an embodiment of an apparatus of the present invention.

FIG. 7 is a flowchart showing the sampling clock interrupt process performing the calculation for updating the reproduction position PP. This arithmetic process is executed periodically by an interrupt, and this interrupt is generated at the period of the sampling clock (sampling frequency). That is to say, the reproduction position PP is updated by increasing it by the advance value TR in synchronization with the sampling clock.

When the interrupt for each sampling clock is generated in FIG. 7, the advance value TR is added to the present reproduction position PP and updated to the new reproduction position PP (step D1). Then, it is determined whether the updated reproduction position PP has exceeded the end address of the audio waveform (step D2), and if it has exceeded the end address, then the reproduction position PP is held at the end address (step D3) because the reproduction position PP cannot be advanced any further. If it has not exceeded the end address, then the updated reproduction position PP is output to the advance value generation means (time axis compression/expansion information generation means) 76 (step D4). This causes the time axis compression/expansion information generation processing portion of the tempo clock interrupt process in FIG. 6 to produce the advance value (time axis compression/expansion information) TR. Then, in the following process, which corresponds to the time axis compression/expansion processing means 74, a time axis compression/expansion process is performed while reading out a PCM waveform data string from the waveform memory 8 based on the advance value (time axis compression/expansion information) TR (step D5).

The above embodiment has been explained for the case that the original tempo is stored in the waveform memory 8 as the original tempo information of the recorded audio waveform. However, the present invention is not limited to this, and it is also possible to determine beforehand a numerical series determined by successively adding the tempo address length TA determined based on the value of the original tempo (that is, an equivalent to the time series of the aforementioned tempo position TP), store this numerical series beforehand in the waveform memory 8 as the audio tempo information, and read it out sequentially each time a generation timing of the reproduction tempo clock is generated to use it as the tempo position TP.

To make the reproduction several percent faster or slower than the input tempo clock (tempo information), it is possible to multiply the desired coefficient TX to the advance value TR that is output, determine the corrected advance value TR' with an advance value correction portion 763 (see FIG. 8), and supply this corrected advance value TR' instead of the advance value TR to the time axis compression/expansion processing means 74.

Thus, the advance value (time axis compression/expansion information) TR that has been determined as described above is supplied to the time axis compression/expansion processing means 74, the PCM waveform data is read from the waveform memory 8, and the waveform is reproduced. At this time, every time a tempo clock is given as reproduction speed information, the updated tempo position TP and reproduction position PP are compared; and the advance value TR serving as the time axis compression/expansion information is changed in such a manner that if the reproduction position PP is more advanced, the time compression amount is decreased, and if the reproduction position PP is more delayed, the time compression amount is increased. Thus, the original waveform recorded at the original tempo can be reproduced with the reproduction speed of the desired reproduction tempo (that is, the tempo input externally with a MIDI signal or the tempo generated internally with the tempo setting actuator).

The following is a more detailed explanation of an operating example of the time axis compression/expansion processing means 74. The time axis compression/expansion processing means 74 is a means for compressing or expanding the time axis of an audio waveform (PCM waveform data string), which has been stored in the waveform memory 8, depending on the advance value TR (time axis compression/expansion information) that has been input and reproducing the audio waveform. The control of the time axis compression/expansion and the control of the reproduction pitch are independent of each other, so that the pitch will not change due to the time axis compression/expansion.

Figure 11:
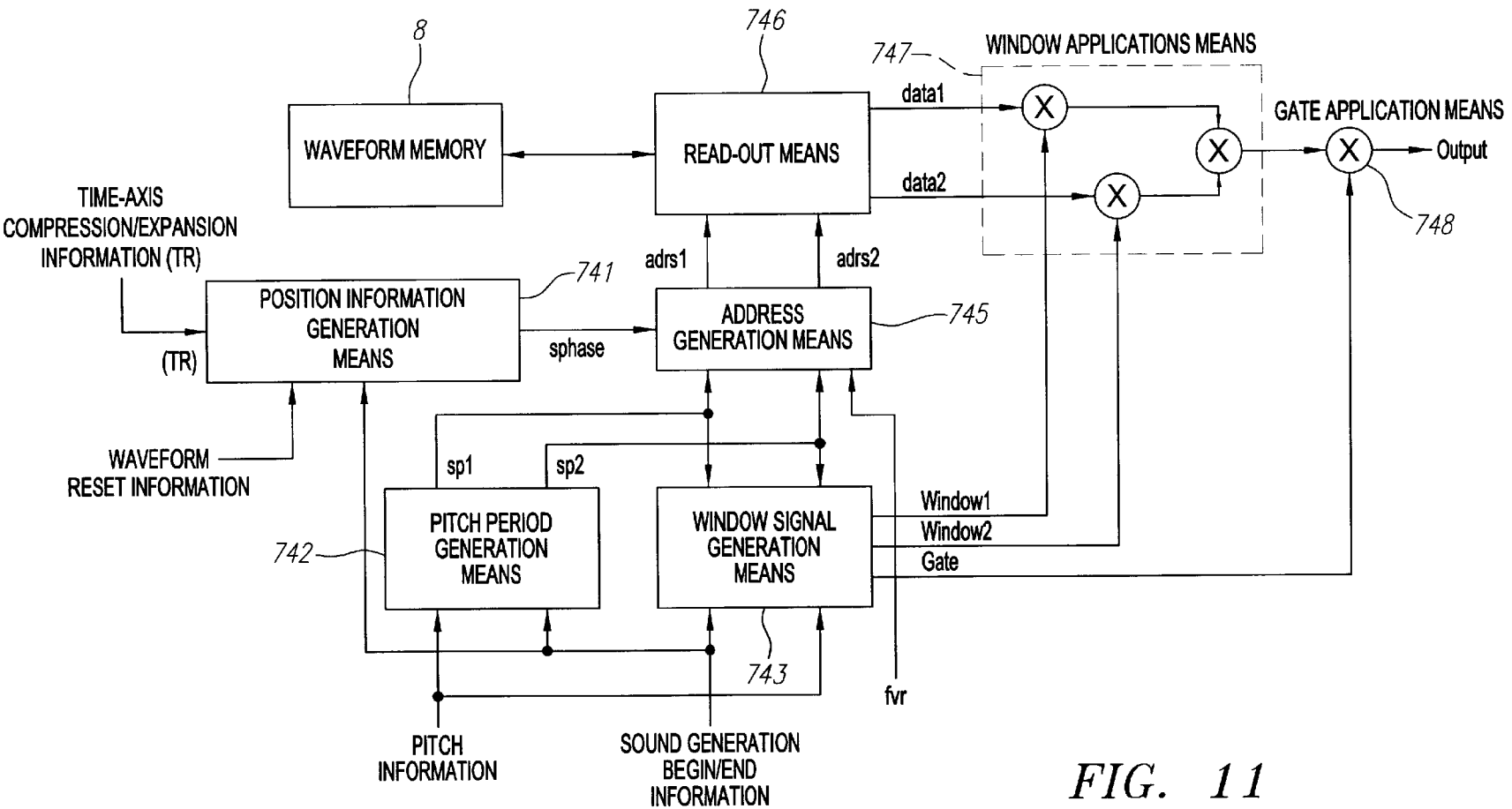
FIG. 11 is an outline of the configuration of the time axis compression/expansion processing means 74 in the DSP of an apparatus of the present invention in the form of functional blocks.

FIG. 11 shows the configuration of this time axis compression/expansion processing means 74 in detail in the form of functional blocks. FIGS. 14 to 19 are waveform diagrams of the various signals under various conditions, to illustrate the time axis compression/expansion process with the time axis compression/expansion processing means 74.

As shown in FIG. 11, the time axis compression/expansion processing means 74 includes a position information generation means 741 for generating the position information "sphase" from, for example, the input time axis compression/expansion information (advance value) TR, a pitch period generation means 742 for generating pitch period signals "sp1" and "sp2" from, for example, the input pitch information, a window signal generation means 743 for generating window signals "window1" and "window2" and a gate signal "gate" from, for example, the input pitch information, an address generation means 745 for generating read-out addresses "adrs1" and "adrs2" based on the input position information "sphase" and the pitch period signals "sp1" and "sp2", a read-out means 746 for reading out the PCM waveform data from the waveform memory 8 based on the input read-out addresses "adrs1" and "adrs2", a window application means 747 for applying windows to the PCM waveform data "data1" and "data2" that have been read out, and synthesizing them, and a gate application means 748 for applying a gate to the synthesized waveform data.

The time axis compression/expansion processing means 74 successively cuts off a cut-off waveform (a periodic section of the audio waveform of about one to two pitch portions near the position specified by the position information "sphase") from the PCM waveform data string of the waveform memory 8 and substantially retaining the characteristics of the formants of the cut-off waveform, and reproduces the cut-off waveform at a pitch corresponding to the desired reproduction pitch, so that an audio waveform can be produced at the reproduction pitch retaining the formant characteristics of the original audio waveform. This reproduction pitch is changed depending on the pitch of the pressed key on the keyboard, but the speed of the waveform reproduction, that is, the reproduction tempo is controlled by the advance value TR serving as the time axis compression/expansion information without influencing the reproduction pitch, so that both can be controlled independently from one another.

To be specific, cut-off waveforms near the position specified by the position information "sphase" determined by the advance value TR (time axis compression/expansion information) deciding the reproduction speed are cut off sequentially over the passage of time from the PCM waveform data string in the waveform memory 8, and the cut-off waveforms that have been cut off are reproduced with pitch and formant that are different from the original audio waveform. The reproduction of the cut-off waveforms is performed in parallel by two processing systems, which reproduce cut-off waveforms with periods that are twice as long as that of the reproduction pitch and staggered at half this period (=period of the reproduction pitch) and synthesize them, thus reproducing the audio waveform with the period of the reproduction pitch and performing time axis compression/expansion based on the advance value TR serving as the time axis compression/expansion information.

Figure 12:
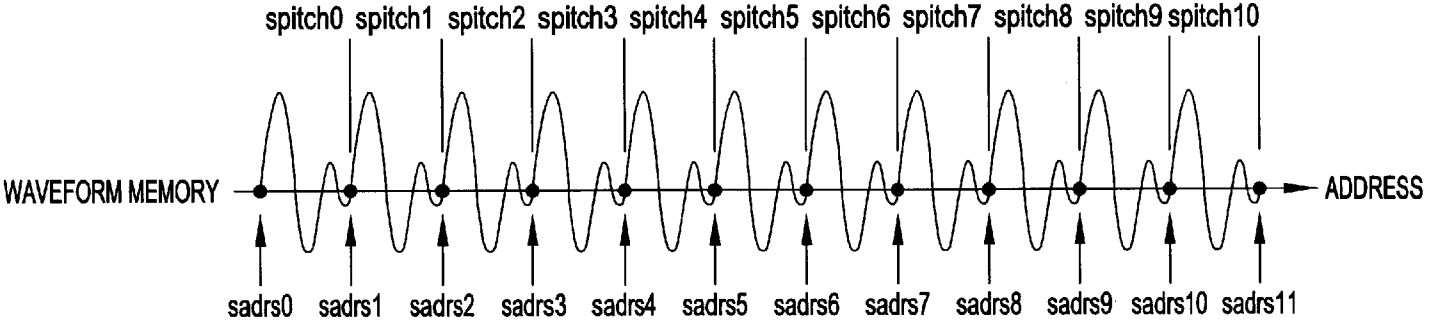
FIG. 12 illustrates the waveform-related information of the waveform data used by the time axis compression/expansion processing means 74 with the formant format in an embodiment of an apparatus of the present invention.
Figure 13:
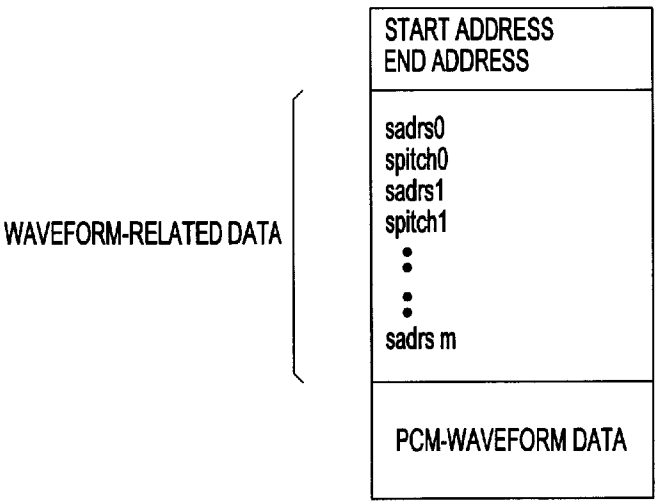
FIG. 13 illustrates the structure of the waveform data stored in the waveform memory 8 in an apparatus of the present invention.

To perform this time axis compression/expansion, the start addresses "sadrs0", "sadrs1", etc. of the periods and the periods "spitch0", "spitch1", etc. of the sampled audio waveform are determined beforehand, as shown in FIG. 12, and recorded as the waveform-related information in the waveform memory 8, as shown in FIG. 13. As has been explained above, besides the PCM waveform data, the start address (first address) and the end address (last address) of the PCM waveform data string are also stored in the waveform memory 8.

As pointed out above, the waveform memory also stores the original tempo, but because it is not directly related to the explanation of the operation of the time axis compression/expansion processing means 74 itself, it has been omitted from FIG. 13.

The following is a more detailed explanation of how the blocks of the time axis compression/expansion processing means 74 operate.

Position Information Generation Means 741

Based on the input advance value TR, the position information generation means 741 calculates the position information "sphase" indicating the reproduction position of the audio waveform in FIG. 12. This position information "sphase" represents the waveform address of the PCM waveform data at the position in the audio waveform being reproduced.

Herein, the advance value TR (time axis compression/expansion information) takes on the following value.

(1) If the time axis is neither compressed nor expanded, then TR=1. In this case, the reproduction position (position information "sphase") proceeds one address per sampling period, so that the original audio waveform is reproduced without compression of the time axis (that is, in the original tempo).

(2) If the time axis is compressed, then TR>1. In this case, the reproduction position proceeds more than one address per sampling period, so that the original audio waveform is reproduced with compression of the time axis.

(3) If the time axis is expanded, then TR<1. In this case, the reproduction position proceeds less than one address per sampling period, so that the original audio waveform is reproduced with expansion of the time axis.

At each sampling period, the position information generation means 741 adds the advance value TR to calculate the position information "sphase". This position information "sphase" is set to the start address by the sound generation begin instruction with the sound generation begin/sound generation end information. Moreover, the position information "sphase" is set to the start address also in response to the input of a waveform reset signal and sets the reproduction position to the start of the PCM waveform data string.

Pitch Period Generation Means 742

The pitch period generation means 742 generates the pitch period signals "sp1" and "sp2", whose period corresponds to the period of the pitch of the reproduction audio waveform, in accordance with the input pitch information that is input. The pitch period signals "sp1" and "sp2" output by the pitch period generation means 742 are shown in FIGS. 14 to 19 (C). The pitch period generation means 742 begins the generation of the pitch period signals "sp1" and "sp2" after synchronization with the sound generation begin instruction with the sound generation begin/sound generation end information.

The period after the pitch period signal "sp1" has been generated until the pitch period signal "sp2" is generated and the period after the pitch period signal "sp2" has been generated until the pitch period signal "sp1" is generated serve as the period of the pitch of the reproduction audio waveform. Therefore, considering only the pitch period signals "sp1" and "sp2", signals with twice the length of the period of the reproduction pitch are generated.

Address Generation Means 745

The address generation means 745 includes two counters pph1 and pph2 which are reset by the pitch period signals "sp1" or "sp2" output from the pitch period generation means 742 and incremented by one at each sampling period. The series of output values of the counters pph1 and pph2 is shown in FIGS. 14 to 19 (D). These output values of the counters pph1 and pph2 are used as waveform addresses when the aforementioned cut-off waveform is read out.

Moreover, the address generation means 745 can change the advance amount by multiplying the output of the counters pph1 and pph2 with a formant coefficient "fvr". In particular, it calculates (pph1×fvr) and (pph2×fvr).

Here, "fvr" is a coefficient for setting the amount of change of the formants. Changing the formants can be accomplished with this coefficient. For example, it is possible to let the actuator group include an actuator for the formants, detect its actuation with the CPU, and supply it as formant coefficient "fvr" to the DSP, so that (1) if fvr=1, then the formants are not changed, (2) if fvr>1, then the formants are shifted to a higher frequency band, (3) if fvr <1, then the formants are shifted to a lower frequency band.

It should be noted that since this control is not directly related to the present invention, the detailed processes with the CPU have been omitted.

Every time the pitch period signals "sp1" and "sp2" are input from the pitch period generation means 742, the address generation means 745 holds the start addresses "sadrs0", "sadrs1", etc. of the waveform period section (that is, the cut-off waveform) indicated by the position information "sphase" in the registers "reg1" and "reg2" (see FIGS. 14 to 19). Then, the sum of the aforementioned (pph1×fvr) and the register "reg1" is output as the read-out address "adrs1", and the sum of the aforementioned (pph2×fvr) and the register "reg2" is output as the read-out address "adrs2" to the read-out means 746.

Read-Out Means 746

The read-out means 746 reads out the PCM waveform data "data1" and "data2" from the waveform memory 8, based on the read-out addresses "adrs1" and "adrs2" supplied from the address generation means 745. Here, the read-out addresses "adrs1" and "adrs2" are addresses including a decimal point, so that the PCM waveform data is interpolated by the read-out means 746 and taken as the PCM waveform data "data1" and "data2" corresponding to the decimal address. Examples of the PCM waveform data "data1" and "data2" read out from the waveform memory 8 are shown in FIGS. 14 to 19 (E).

Window Signal Generation Means 743

Depending on the input pitch information and the sound generation begin/sound generation end information, the window signal generation means 743 produces and outputs a gate signal "gate" and window signals "window1" and "window2".

Figure 14:
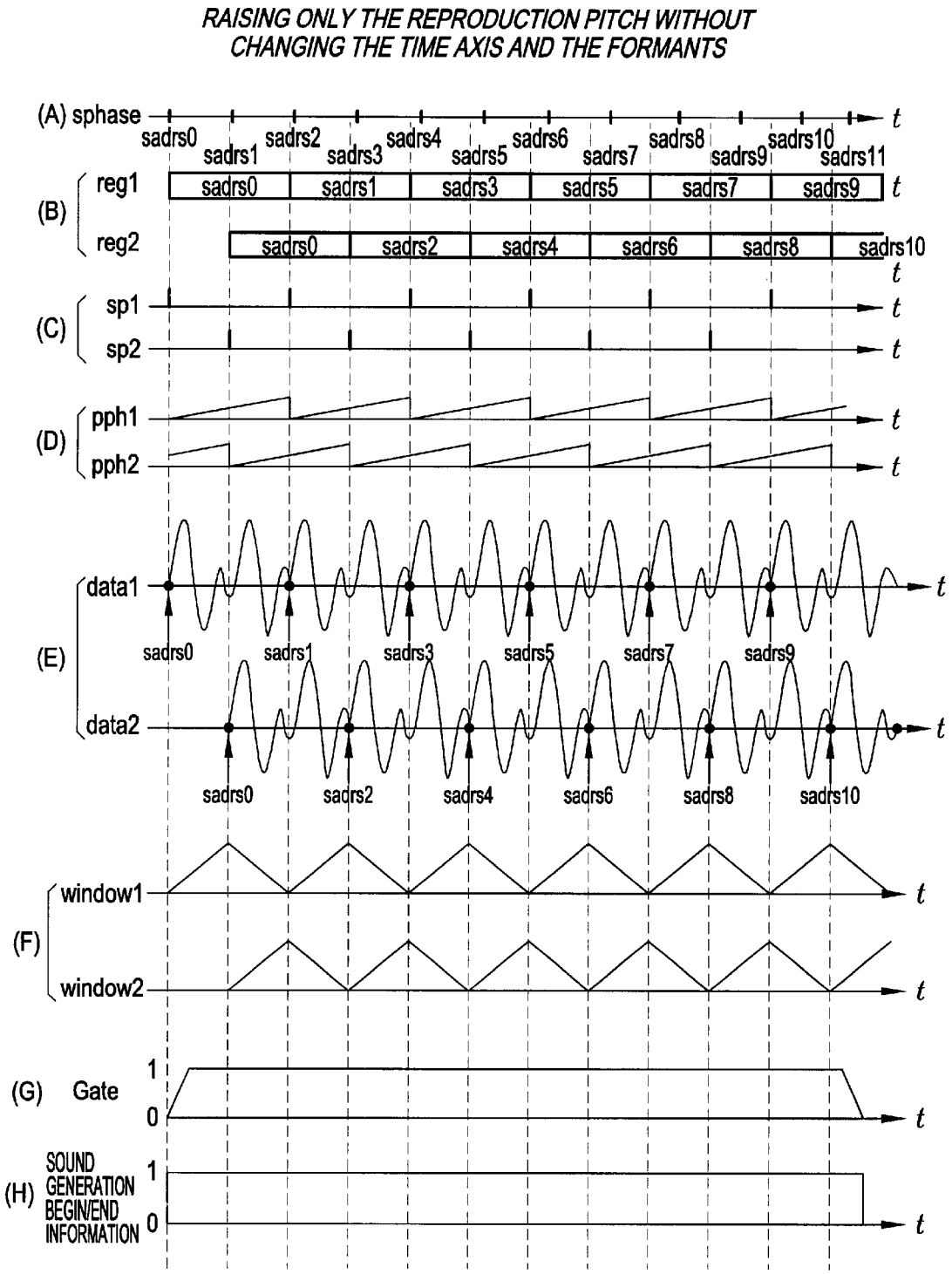
FIG. 14 is a waveform diagram of the process when only the reproduction pitch is raised without changing the time axis and the formants in the time axis compression/expansion processing means 74 of an apparatus of the present invention.

As shown by the example in FIG. 14 (G), the gate signal "gate" has a rising and a falling flank corresponding to the sound generation begin/sound generation end information. This gate signal prevents, at the begin and the end of a sound generation, the level of the reproduced audio waveform from changing abruptly and causing noise. The gate signal is applied (multiplied) by the gate application means 748 to the audio waveform that is finally output.

If the PCM waveform data "data1 " and "data2" that have been read out with the read-out means 746 are synthesized and changed, then their levels become noncontinuous, so that the window signals "window1" and "window2" are provided to reduce the level of this noncontinuous portion, as shown by the examples in FIGS. 14 to 19 (F). The level of this noncontinuous portion is reduced by applying (multiplying) the triangular window signals "window1" and "window2" with the PCM waveform data "data1" and "data2". The window signal generation means 743 generates the window signals "window1" and "window2" with a period that corresponds to the reproduction pitch (namely, twice the period of the reproduction pitch), and their phases are staggered by the period of the reproduction pitch.

Window Application Means 747

The window application means 747 applies (multiplies) the window signals "window1" and "window2" to the PCM waveform data "data1" and "data2" that have been read out from the read-out means 746 and produces the reproduction audio waveform by adding the results.

Gate Application Means 748

The gate application means 748 applies the gate signal "gate" to the reproduction audio waveform produced with the window application means 747 and prevents the generation of noise due to abrupt volume changes at the begin or end of the sound generation.

FIG. 14 is a waveform diagram of the process when only the reproduction pitch is raised without changing the time axis and the formant. In this case, the reproduction pitch becomes higher than the pitch of the original audio waveform, so that cut-off waveforms (for example, the waveform data of the cut-off waveform starting at "sadrs0" shown in (B) and (E)) are repeated as appropriate.

Figure 15:
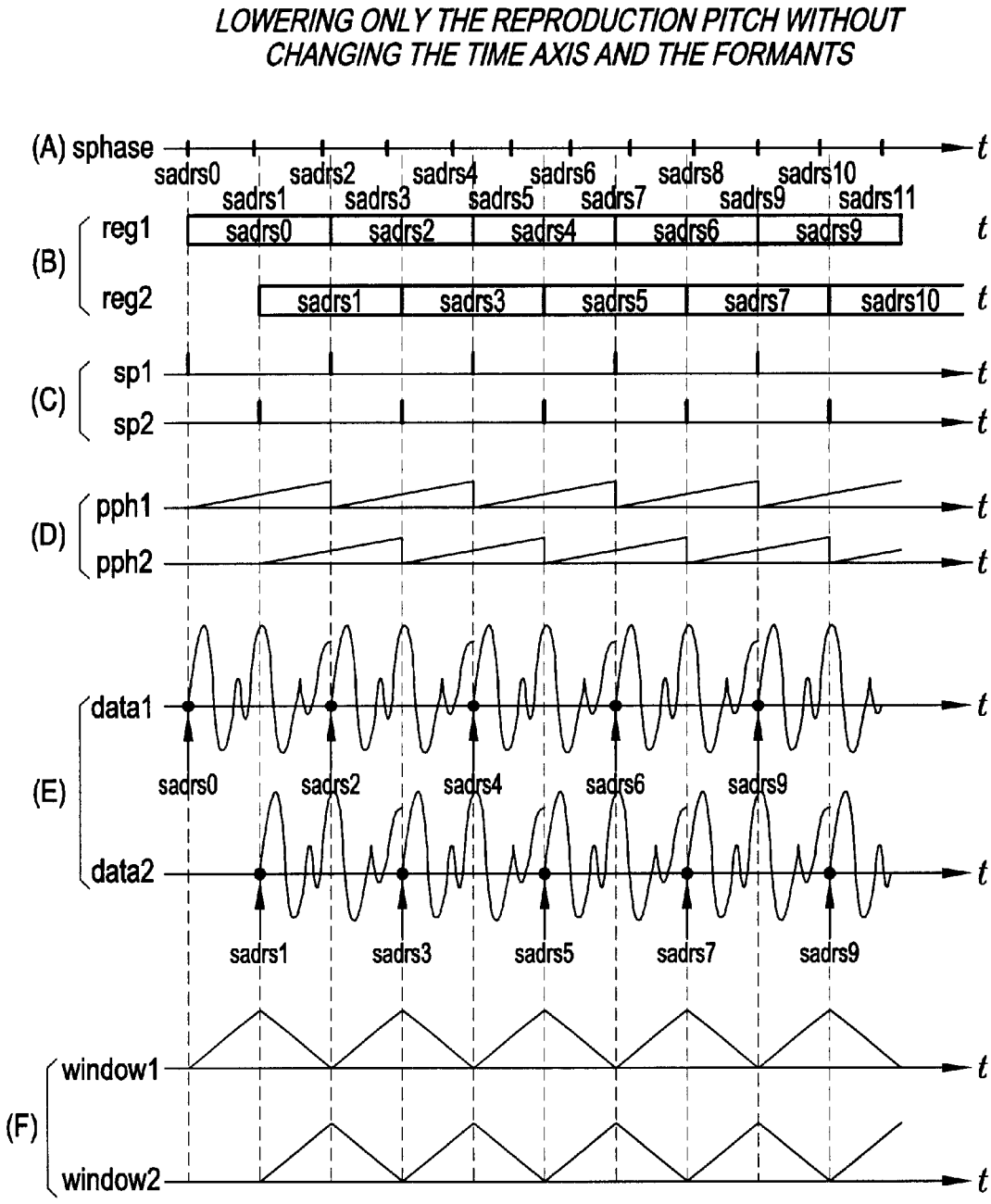
FIG. 15 is a waveform diagram of the process when only the reproduction pitch is lowered without changing the time axis and the formants in the time axis compression/expansion processing means 74 of an apparatus of the present invention.

FIG. 15 is a waveform diagram of the process when only the reproduction pitch is lowered without changing the time axis and the formants. In this case, the reproduction pitch becomes lower than the pitch of the original audio waveform, so that cut-off waveforms (for example, the waveform data of the cut-off waveform starting at "sadrs8" shown in (B) and (E)) are culled out as appropriate.

Figure 16:
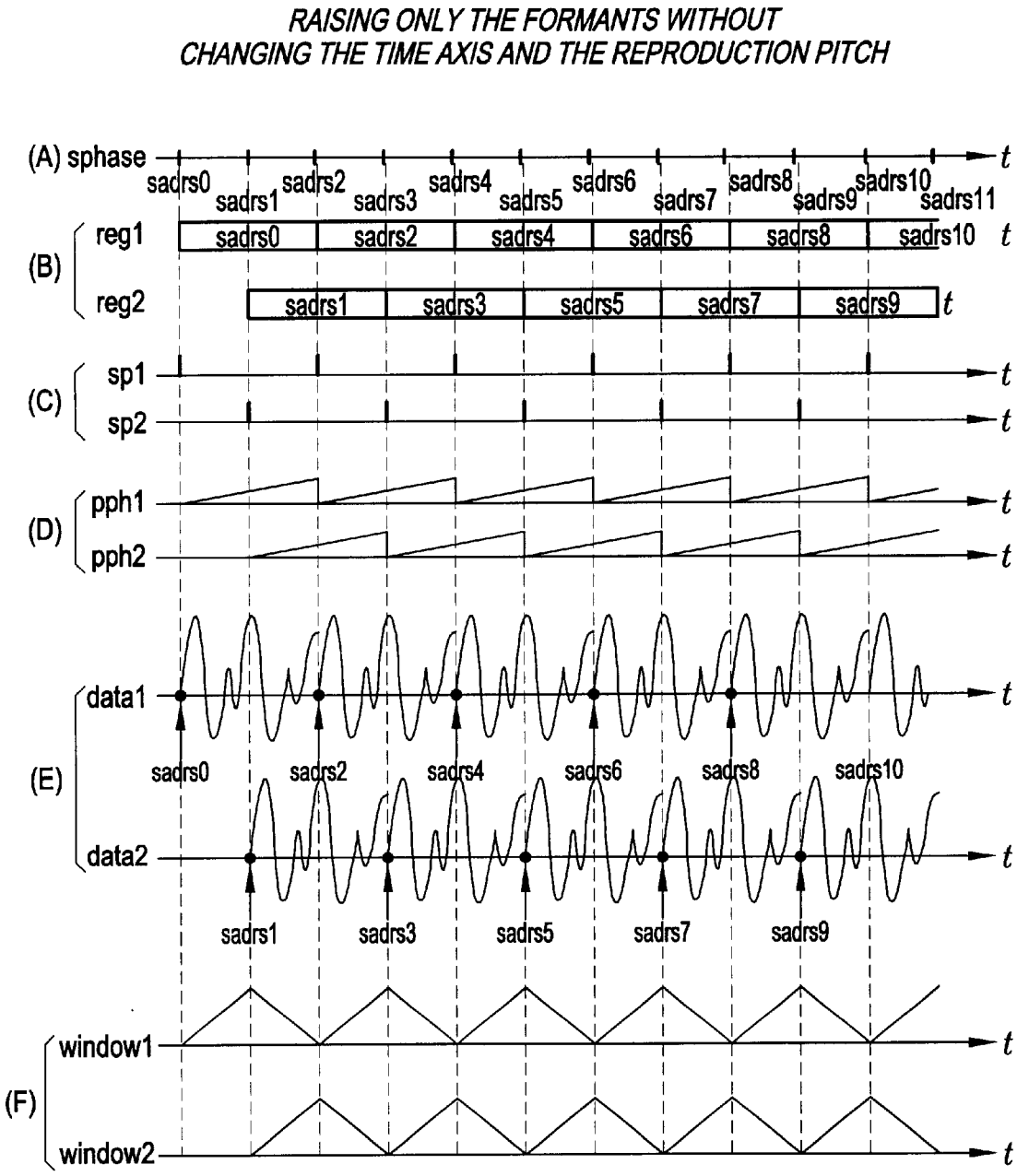
FIG. 16 is a waveform diagram of the process when only the formants are raised without changing the time axis and the reproduction pitch in the time axis compression/expansion processing means 74 of an apparatus of the present invention.

FIG. 16 is a waveform diagram of the process when only the formant is raised without changing the time axis and the reproduction pitch. As shown in (E), the read-out waveform data are compressed in the direction of the time axis.

Figure 17:
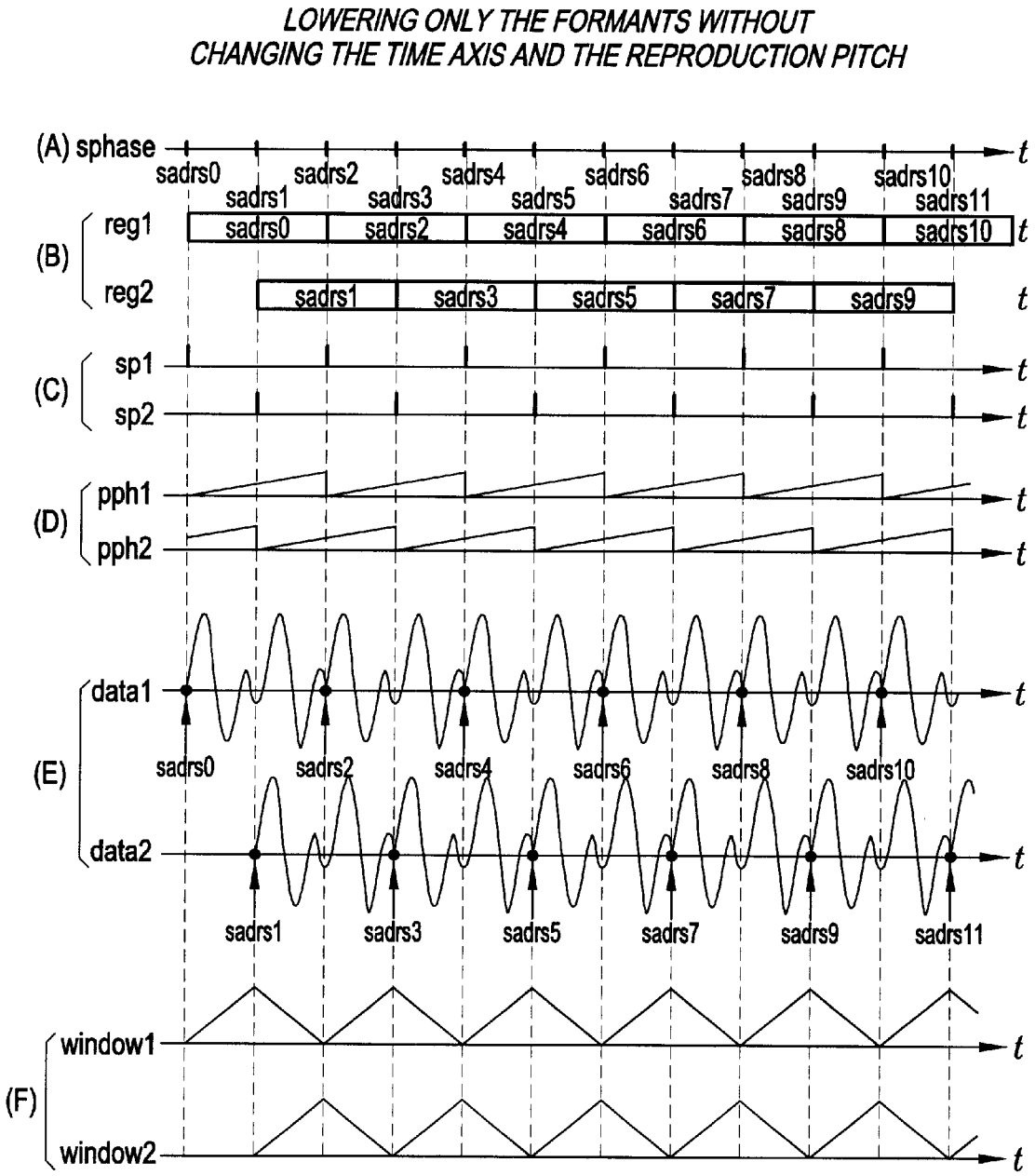
FIG. 17 is a waveform diagram of the process when only the formants are lowered without changing the time axis and the reproduction pitch in the time axis compression/expansion processing means 74 of an apparatus of the present invention.

FIG. 17 is a waveform diagram of the process when only the formant is lowered without changing the time axis and the reproduction pitch. As shown in (E), the waveform data that have been read out are expanded in the direction of the time axis.

Figure 18:
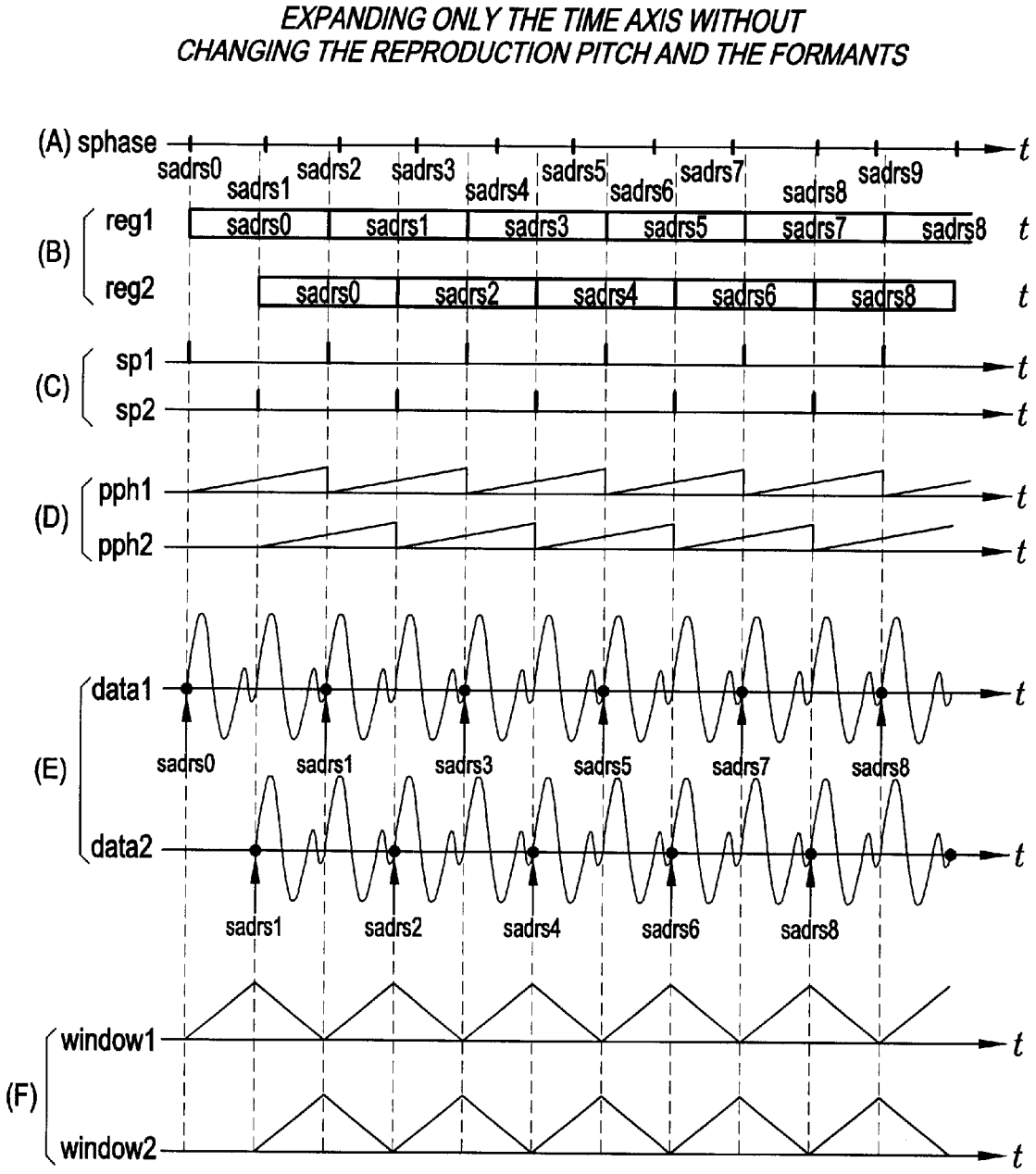
FIG. 18 is a waveform diagram of the process when only the time axis is expanded without changing the reproduction pitch and the formants in the time axis compression/expansion processing means 74 of an apparatus of the present invention.

FIG. 18 is a waveform diagram of the process when only the time axis is expanded without changing the reproduction pitch and the formant. As shown in (A), the change of the position information "sphase" representing the reproduction position is expanded in the direction of the time axis. At the same time, the same waveform data (cut-off waveform data from "sadrs0" and "sadrs8") are repeated, as shown in (E).

Figure 19:
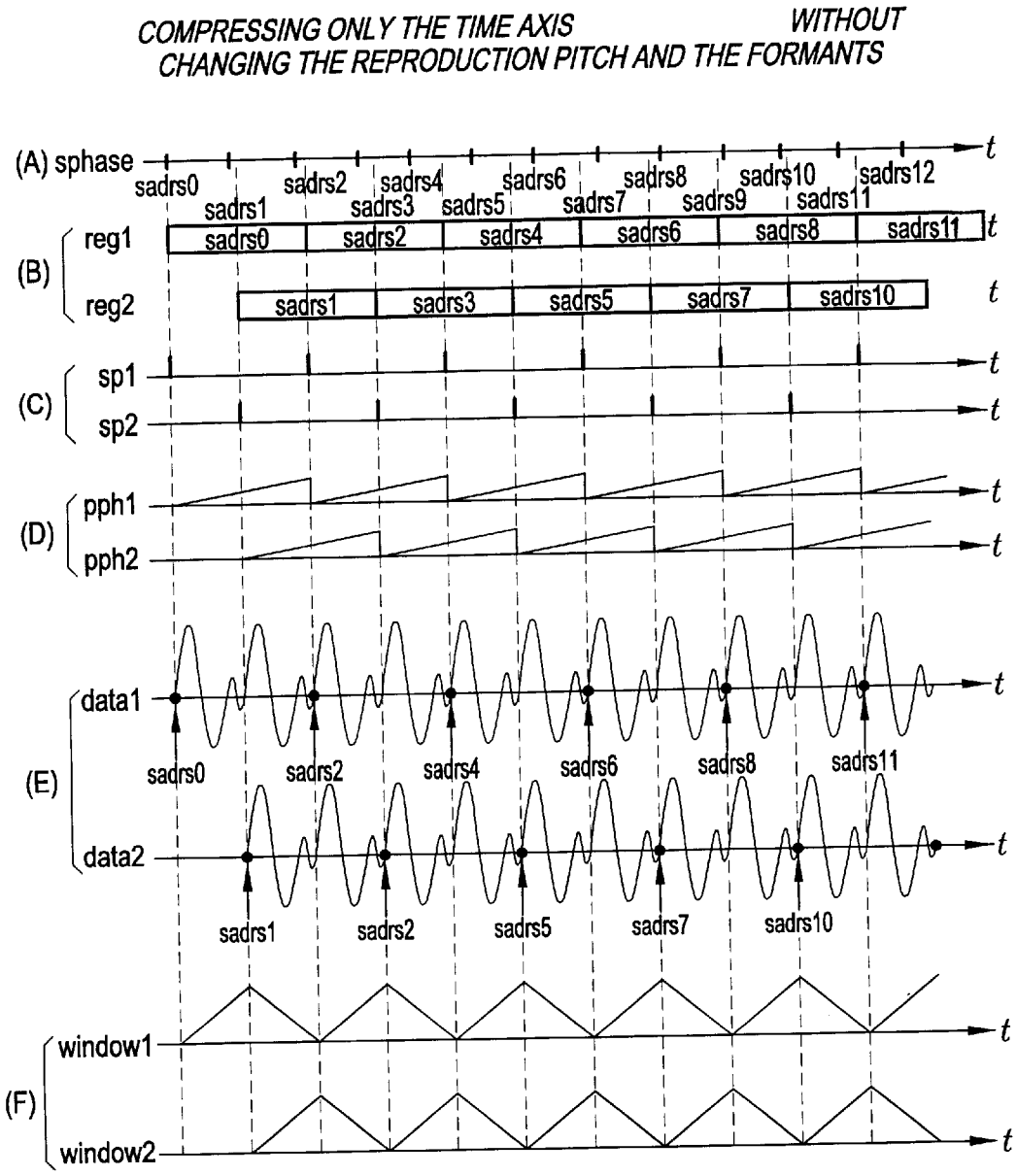
FIG. 19 is a waveform diagram of the process when only the time axis is compressed without changing the reproduction pitch and the formants in the time axis compression/expansion processing means 74 of an apparatus of the present invention.

FIG. 19 is a waveform diagram of the process when only the time axis is compressed without changing the reproduction pitch and the formant. As shown in (A), the change of the position information "sphase" representing the reproduction position is compressed in the direction of the time axis. At the same time, waveform data (cut-off waveform data starting at "sadrs9") are culled, as shown in (E).

Various embodiments are possible to embody the present invention. For example, in the above embodiment, the time axis compression/expansion processing means 74 uses a format realizing the time axis compression/expansion process with PCM waveform data strings in which amplitude values are sampled as the waveform data of the audio waveform. However, the present invention is not limited to this, and it is equally possible to perform the time axis compression/expansion process using, for example, the phase vocoder format in the time axis compression/expansion processing means 74. In this case, for example, amplitude and frequency information or amplitude and phase information are stored beforehand as waveform data. The following is an explanation of this phase vocoder format.

In this phase vocoder format, the waveform data stored in the waveform memory 8 are analysis data obtained by analyzing the original waveform. For their time axis, the addresses at the time when the original audio waveform has been stored as PCM waveform data that actually do not exist (virtual addresses) can be used in the same manner as for the PCM waveform data.

That is to say, the phase vocoder format is made up by and large of an analysis system and a synthesis system. With the analysis system, the audio waveform of the original sound is divided into a plurality of frequency regions (bands) with bandpass filters, and the band components of the bands are analyzed to extract the output amplitude and phase as characteristic parameters; whereas, with the synthesis system, the original band components of each band are reproduced using the output amplitude and phase, and the band components of each band are synthesized by adding them together to restore the original audio waveform.

Figure 23:
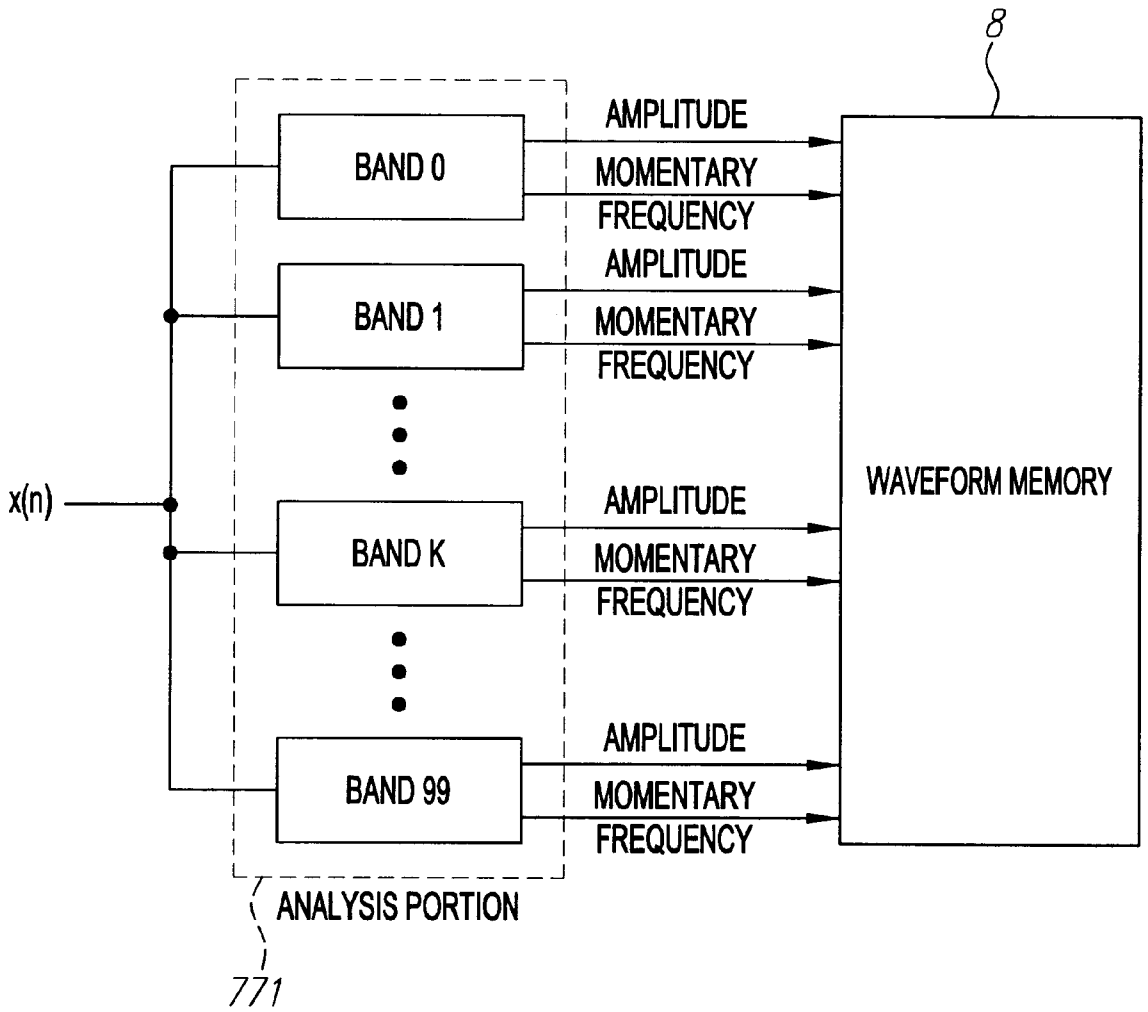
FIG. 23 shows, in the form of functional blocks, the configuration of the analysis system of the time axis compression/expansion processing means with the phase vocoder format in the other embodiment.
Figure 25:
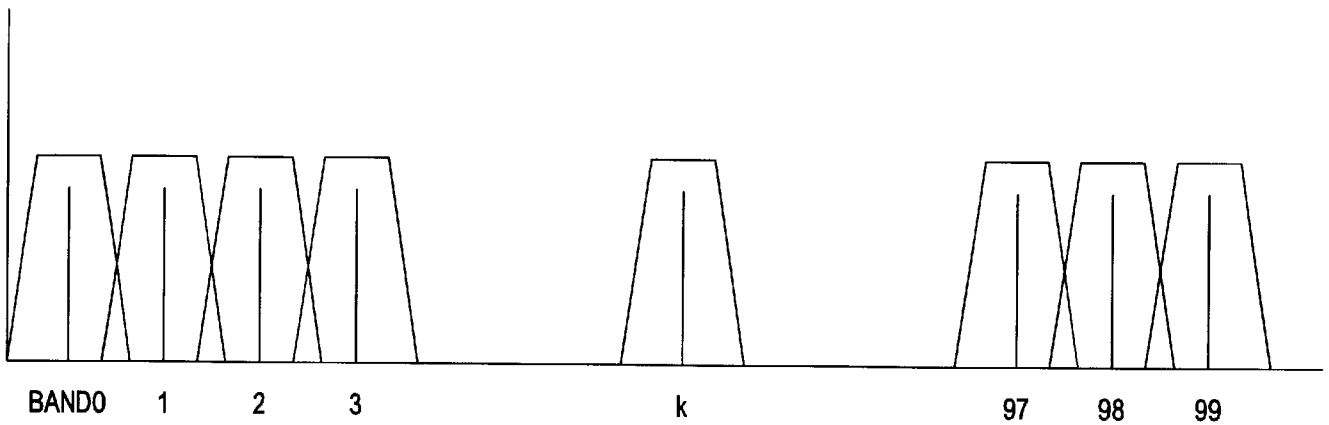
FIG. 25 illustrates an outline of the frequency regions (bands) in the time axis compression/expansion processing means with the phase vocoder format in the other embodiment.

FIG. 23 outlines the structure of the analysis system of such a phase vocoder format. As shown in this drawing, an audio waveform X(n) is input into an analysis portion 771. In this example, the analysis portion 771 has analysis filters corresponding to the 100 bands into which the frequencies of the audio waveform have been partitioned, and the momentary frequency information and the amplitude information are produced by analysis for each frequency band. To be specific, the analysis portion 771 has analysis filters for the bands 0 to 99 (see FIG. 25), whose center frequencies correspond to the base frequencies of the band components of the audio waveform.

Figure 24:
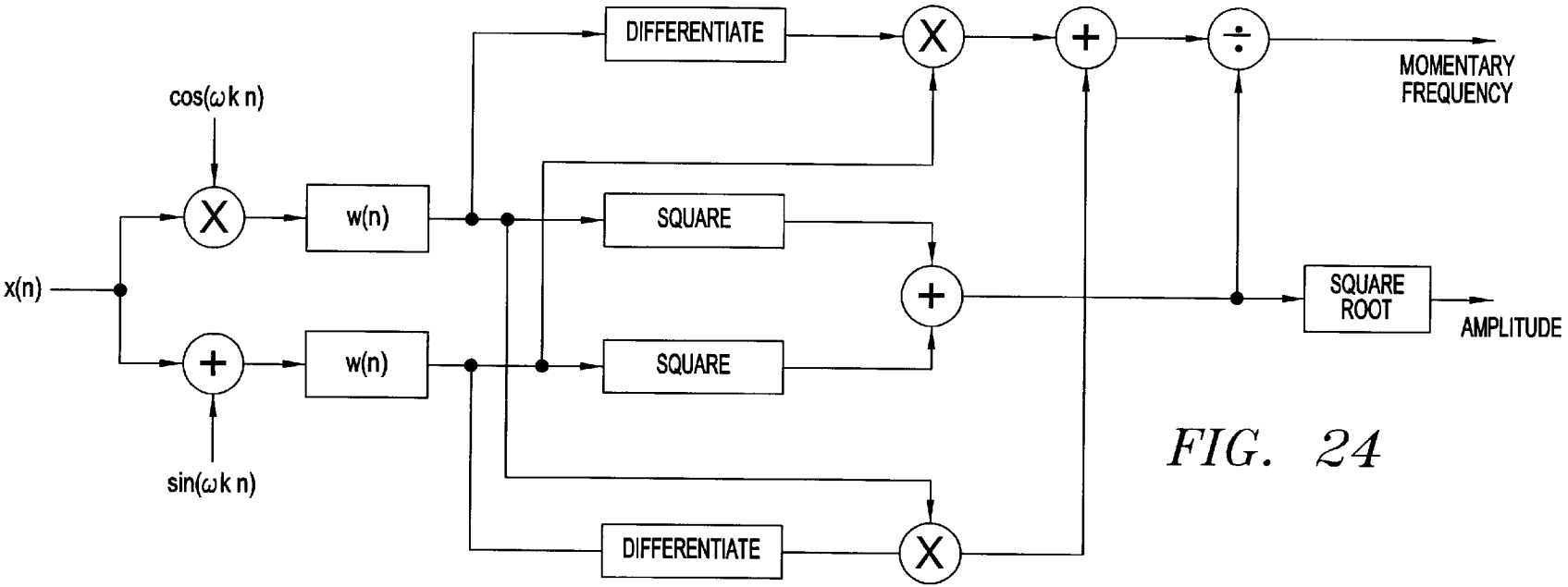
FIG. 24 shows, in the form of functional blocks, the configuration of the band analysis filters of the analysis system of the time axis compression/expansion processing means with the phase vocoder format in the other embodiment.

FIG. 24 shows a configuration example of an analysis filter for the band k. As shown in this drawing, this analysis filter multiplies the audio signal waveform X(n) that has been input with its central complex frequency sin(ukn) or cos(ukn) (homodyne detection), cuts the waveform with w(n), which is the impulse response of an analysis filter, and analytically develops amplitude value and the momentary frequency. This operation is equivalent to a short-interval Fourier transformation cut out by the window w(n). The information of the momentary frequency is derived by first obtaining the output amplitude of the band k and differentiating the phase value of its detection output. This momentary frequency is the amount of change (differential value) of the phase per unit time at each point in time (that is, each position on the time axis of the waveform) and indicates the frequency deviation from the center frequency.

The waveform data (output amplitude and momentary frequency) of each band of the audio waveform X(n) that have been determined with the analysis system are stored in the waveform memory 8 (see FIG. 22(*a*)). The storage of the waveform data into the waveform memory 8 is accomplished by storing amplitude data and momentary frequency data for each band 0–99 at each address (that is, the previously mentioned virtual addresses) on the time axis of the audio waveform X(n).

Figure 20:
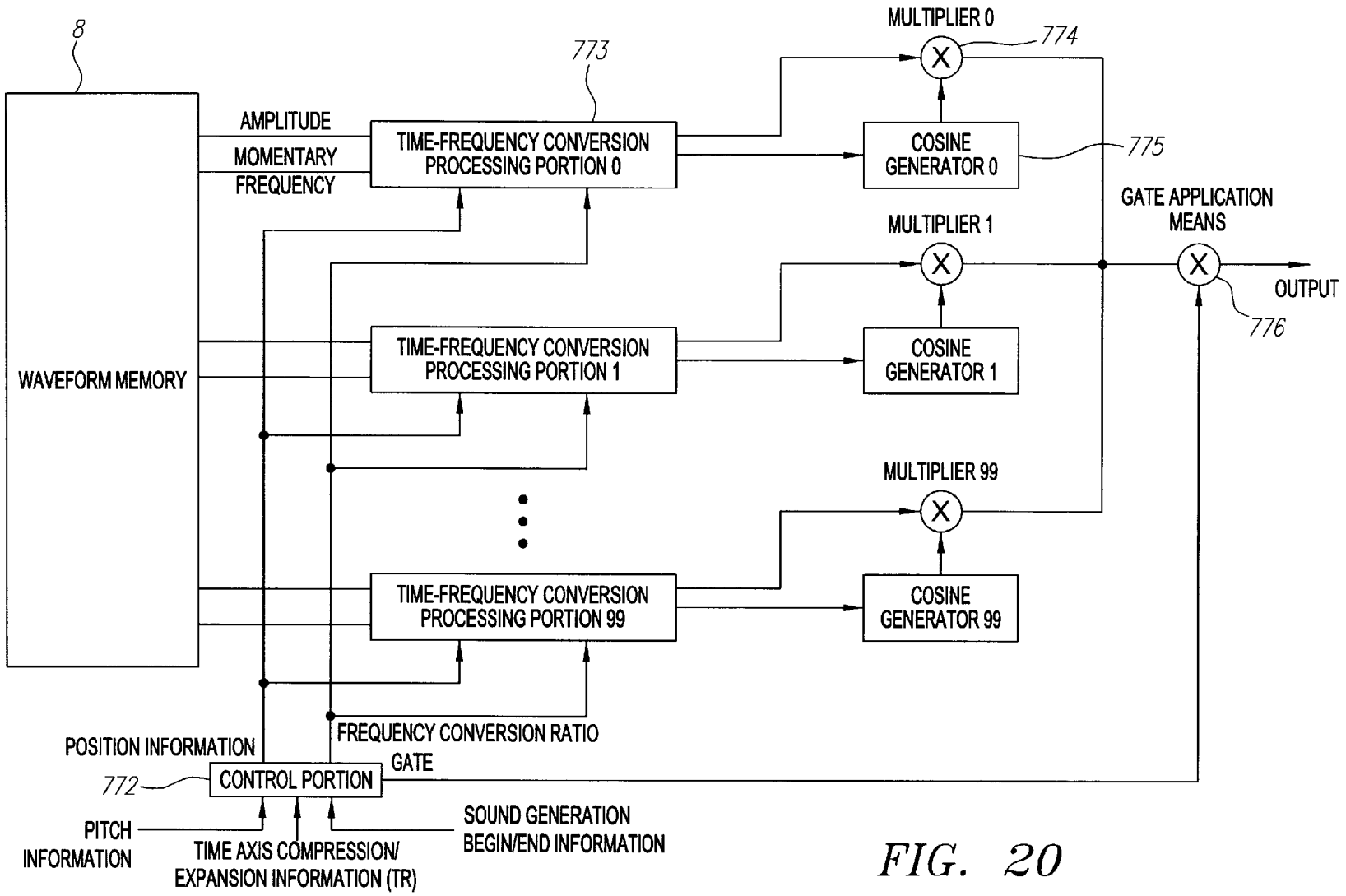
FIG. 20 shows, in the form of functional blocks, the configuration of a synthesis system of a time axis compression/expansion processing means with the phase vocoder format in another embodiment.

FIG. 20 is a block diagram showing the configuration of the synthesis system. The control portion 772 has the function to have the advance value TR (time axis compression/expansion information) input into it and calculate the position information corresponding to the previously mentioned "sphase" (see FIG. 11);

the function to have the pitch information input into it and calculate a frequency conversion ratio;

the function to have the sound generation begin/end information input into it and produce the gate signal "gate" corresponding to FIG. 14 (G).

The time-frequency conversion processing portions 773 for the 100 frequency bands interpolate the analysis data stored in the waveform memory 8 in accordance with the position information, and multiply the frequency conversion ratio with the momentary frequency information while performing time axis compression/expansion (see FIG. 22), so as to shift the frequency components of the audio waveform to be resynthesized.

The momentary frequency information and the amplitude values, for which time axis compression/expansion has been performed with the time-frequency conversion processing portions 773 are input into cosine generators 775 and multipliers 774, which resynthesize the audio waveforms of all frequency bands with compressed/expanded time axis. By synthesizing the audio waveforms of these bands, a reproduction audio waveform is synthesized that has been subjected to time axis compression/expansion. This signal is input into the gate application means 776, and its amplitude is controlled with the gate signal "gate" so as to prevent the generation of noise at the begin or the end of the sound generation.

Figure 21:
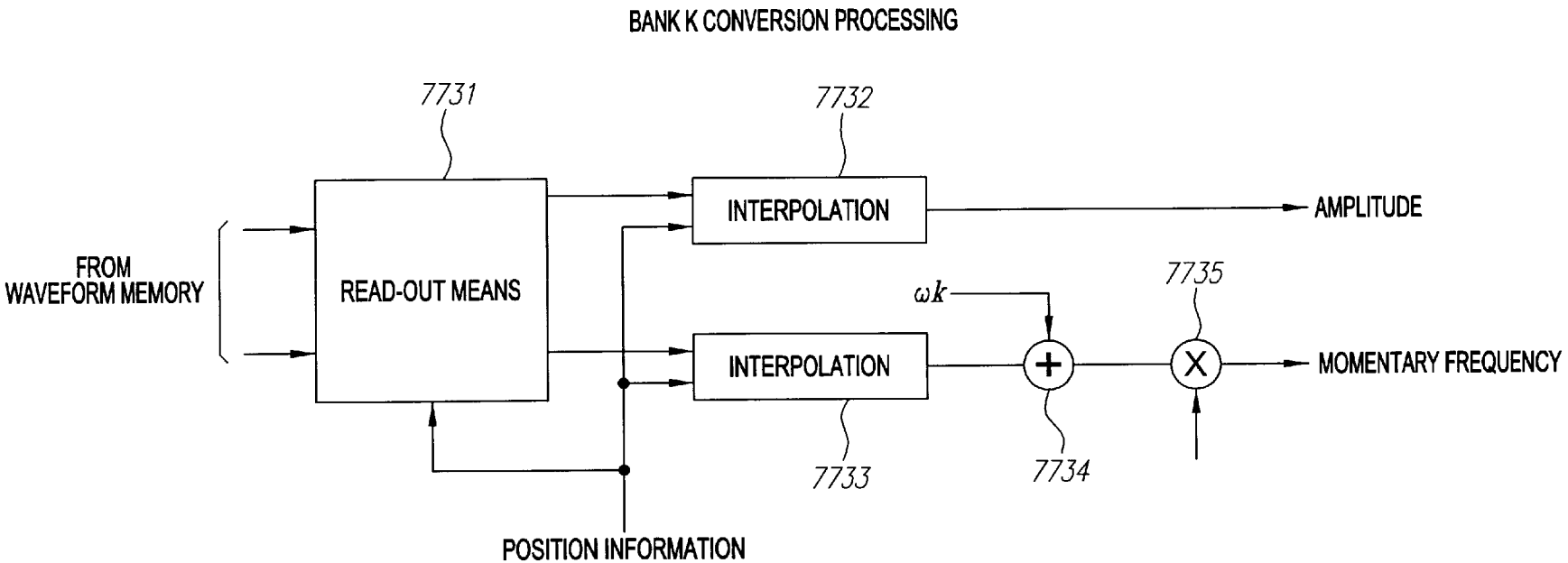
FIG. 21 shows, in the form of functional blocks, the configuration of a synthesis system of the time-frequency conversion processing means of the time axis compression/expansion processing means with the phase vocoder format in the other embodiment.

FIG. 21 shows the block configuration of the time-frequency conversion processing portions 773 in more detail. A time-frequency conversion processing portion 773 includes a read-out means 7731, interpolation means 7732 and 7733, an adder 7734, and a multiplier 7735. The processes performed by the time-frequency conversion processing portions 773 include the reading out of the analysis data (that is, amplitude information and momentary frequency information) corresponding to the position information with the read-out means 7731, and the interpolation of information that actually does not exist with the interpolation means 7732 and 7733. Thus, analysis data (that is, amplitude information and momentary frequency information) that corresponds to changes of the position information are calculated.

That is to say, the interpolation means 7732 interpolates by leaving out or adding sampling points to the output amplitude values depending on the ratio of the time axis compression/expansion and outputs amplitude values whose amplitude envelope (that is, the envelope indicating the temporal change of the amplitude values) has been compressed or expanded. The interpolation means 7733 interpolates by leaving out or adding sampling points to the momentary frequency values depending on the ratio of the time axis compression/expansion and outputs momentary frequency values whose frequency envelope has been compressed or expanded. The adder 7734 adds the center angular frequency uk to these momentary frequency values; and if a pitch conversion is performed, the multiplier 7735 multiplies these momentary frequency values with the frequency conversion ratio (that is, the ratio corresponding to the extent of the pitch shift).

FIG. 22 illustrates the interpolation process of the amplitude values and the momentary frequency values. In the case of a temporal expansion, both the original amplitude envelope and frequency envelope shown in FIG. 22(*a*) are stretched out, as shown in FIG. 22(*b*), and amplitude values and momentary frequency values that are expanded on the time axis are produced. In the case of a temporal compression, both the original amplitude envelope and frequency envelope are squeezed, as shown in FIG. 22(*c*), and amplitude values and momentary frequency values that are compressed on the time axis are produced. With this interpolation process, the time axis of the original audio signal waveform can be compressed or expanded as desired.

The momentary frequency values (which have been subjected to suitable time axis compression/expansion) processed by the time-frequency conversion processing portions 773 are supplied to the cosine generators 774, which generate cosine waves with the frequencies of the corresponding bands; and these cosine waves are subjected to the amplitude envelopes that have been processed with the time-frequency conversion processing portions 773. Thus, the components of the corresponding bands are reproduced. Furthermore, the original audio signal waveform is restored, synthesizing it by adding together the band components of the bands 0 to 99.

All of the above embodiments have been explained for the case that an audio waveform reproduction apparatus in accordance with the present invention is implemented in dedicated hardware, such as an electronic instrument. However, the present invention is not limited to this; and it is also possible, for example, to realize the functions explained above with a control program, store this control program on a storage medium, and install the control program from the recording medium to a personal computer, so as to let the personal computer function as an audio waveform reproduction apparatus. In other words, a program is stored on the recording medium, that lets the personal computer perform the functions described above. Needless to say, the audio waveform reproduction apparatus of the present invention can also be realized by sending such a control program to the personal computer over a communications line to install the program.

As explained above, with the present invention, an audio waveform can be reproduced with a tempo that the user specifies at the time of reproduction by internal settings or external input, without deviating from the tempo. Moreover, even when the tempo is changed during the reproduction, the changed tempo can be quickly accommodated.

Therefore, embodiments of the present invention provide a system and method for reproducing recorded audio waveforms in a manner that does not deviate from the tempo when the reproduction is performed at a desired tempo that is different from the tempo at the time of recording. In addition, embodiments of the present invention provide a system and method for reproducing recorded audio waveforms that precisely follows temporal changes of the tempo, and, in particular, can precisely follow temporal changes of the tempo information in a real-time process.

What is claimed is:

1. An audio waveform reproduction apparatus, comprising:

a storage means for storing waveform data representing an audio waveform;

a reproduction tempo information input means for inputting reproduction tempo information expressing a tempo for a time when the audio waveform is reproduced;

a first time function production means for producing first information (TP) that is a time function based on the reproduction tempo information;

a second time function production means for producing second information (PP) that is a time function based on time axis compression/expansion information (TR);

a time axis compression/expansion information production means for comparing the first information and the second information and calculating the time axis compression/expansion information (TR) towards matching the temporal change of the second information with the temporal change of the first information; and a time axis compression/expansion processing means for subjecting the audio waveform to time axis compression/expansion processing based on the time axis compression/expansion information (TR) to produce a reproduction audio waveform;

wherein the first information (TP) and the second information (PP) represent positions on a common axis.

2. An audio waveform reproduction apparatus as recited in claim 1:

wherein the waveform data of the storage means is PCM data, which are a time series of sampled amplitude data of the audio waveform; and wherein the time axis compression/expansion processing means subjects the PCM data to time axis compression/expansion processing based on the time axis compression/expansion information (TR) to produce the reproduction audio waveform.

3. An audio waveform reproduction apparatus as recited in claim 2, wherein the common axis represents positions of the PCM data in terms of addresses.

4. An audio waveform reproduction apparatus as recited in claim 3:

wherein the storage means also stores original tempo information, which is the tempo of the audio waveform at the time of recording;

wherein the reproduction tempo information is period information of a period corresponding to the reproduction tempo; and wherein the first time function production means calculates the amount of change of addresses per predetermined number of periods of reproduction tempo information based on the original tempo information, and produces the first information, which is a time function representing positions of the PCM data, based on the amount of change of addresses and the reproduction tempo information.

5. An audio waveform reproduction apparatus as recited in claim 4:

wherein the first time function production means calculates the amount of change of addresses per one period of the reproduction tempo information, and produces the first information (TP), which is a time function representing positions of the PCM data, which advance successively by the amount of change every time the reproduction tempo information is input;

wherein the second time function production means produces the second information (PP), which is a time function representing positions of the PCM data, which advance successively by the time axis compression/expansion information (TR) for each reproduction sampling period; and wherein the time axis compression/expansion information production means compares the first information (TP) and the second information (PP) for each reproduction tempo information to calculate the time axis compression/expansion information (TR), which is the advance amount towards matching of the first information and the second information.

6. An audio waveform reproduction apparatus as recited in claim 1:

wherein the waveform data of the storage means are analysis data analyzing and representing the audio waveform; and wherein the time axis compression/expansion processing means subjects the analysis data to time axis compression/expansion processing based on the time axis compression/expansion information (TR) to produce the reproduction audio waveform.

7. An audio waveform reproduction apparatus as recited in claim 6, wherein the common axis represents positions in terms of virtual addresses representing the time axis of the audio waveform.

8. An audio waveform reproduction apparatus as recited in claim 7:

wherein the storage means also stores original tempo information, which is the tempo of the audio waveform at the time of recording;

wherein the reproduction tempo information is period information of periods corresponding to the reproduction tempo; and wherein the first time function production means calculates the amount of change of addresses per predetermined number of periods of reproduction tempo information, based on the original tempo information, and produces the first information, which is a time function representing positions in terms of the virtual addresses, based on the amount of change of addresses and the reproduction tempo information.

9. An audio waveform reproduction apparatus as recited in claim 8:

wherein the first time function production means calculates the amount of change of addresses per one period of the reproduction tempo information and produces the first information (TP), which is a time function representing positions in terms of the virtual addresses, which advance successively by the amount of change every time the reproduction tempo information is input;

wherein the second time function production means produces the second information (PP), which is a time function representing positions in terms of the virtual addresses, which advance successively by the time axis compression/expansion information (TR) for each reproduction sampling period; and wherein the time axis compression/expansion information production means compares the first information (TP) and the second information (PP) for each reproduction tempo information to calculate the time axis compression/expansion information (TR), which is the advance amount towards matching the first information with the second information.

10. An audio waveform reproduction apparatus as recited in any of claims 1 to 9, wherein the production of the audio waveform with the time axis compression/expansion processing means is repeated from the start position of the audio waveform, at a predetermined repetition period that is based on the reproduction tempo.

11. A system for audio waveform reproduction, comprising:

memory for storing audio waveform data representing an original audio waveform;

an actuator for entering reproduction tempo information representing a reproduction tempo; and a processor programmed for generating first information (TP), TP representing both a time function based on the reproduction tempo information and a position on a common axis, generating second information (PP), PP representing both a time function based on time axis compression/expansion information (TR) and a position on the common axis, comparing TP and PP, computing a new value for TR for matching temporal changes of PP to temporal changes of TP, and subjecting the stored audio waveform data to time axis compression/expansion processing based on TR to produce a reproduction audio waveform.

12. A system for audio waveform reproduction as recited in claim 11:

the stored audio waveform data comprising PCM data representing a time series of amplitude data sampled from the original audio waveform; and the processor further programmed for performing time axis compression/expansion processing based on TR on the PCM data to produce the reproduction audio waveform.

13. A system for audio waveform reproduction as recited in claim 12, the common axis representing address positions of the PCM data.

14. A system for audio waveform reproduction as recited in claim 13:

the memory for further storing original tempo information;

the reproduction tempo information comprising period information of a period corresponding to the reproduction tempo; and the processor further programmed for calculating an address change amount per a predetermined number of periods of the reproduction tempo information based on the original tempo information, and generating TP, which is a time function representing positions of the PCM data, based on the address change amount and the reproduction tempo information.

15. A system for audio waveform reproduction as recited in claim 14, the processor further programmed for:

calculating the address change amount per one period of the reproduction tempo information and generating TP, which is a time function representing positions of the PCM data that advances successively by the address change amount every time the reproduction tempo information is entered;

generating PP, which is a time function representing positions of the PCM data that advances successively by an amount equal to TR at each reproduction sampling period; and comparing TP and PP at each period of the reproduction tempo information to calculate TR, which is an advance amount for matching of TP and PP.

16. A system for audio waveform reproduction as recited in claim 11:

the stored waveform data comprising analysis data representing the original audio waveform; and the processor further programmed for performing time axis compression/expansion processing based on TR on the analysis data to produce the reproduction audio waveform.

17. A system for audio waveform reproduction as recited in claim 16, the common axis representing virtual address positions on the time axis of the original audio waveform.

18. A system for audio waveform reproduction as recited in claim 17:

the memory for further storing original tempo information;

the reproduction tempo information comprising period information of periods corresponding to the reproduction tempo; and the processor is further programmed for calculating an address change amount per predetermined number of periods of the reproduction tempo information based on the original tempo information, and generating TP, which is a time function representing positions of the virtual addresses, based on the address change amount and the reproduction tempo information.

19. A system for audio waveform reproduction as recited in claim 18, the processor further programmed for:

calculating an address change amount per one period of the reproduction tempo information and generating TP, which is a time function representing positions of the virtual addresses that advance successively by the address change amount every time the reproduction tempo information is entered;

generating PP, which is a time function representing positions of the virtual addresses that advance successively by an amount equal to TR at each reproduction sampling period; and comparing TP and PP at each period of the reproduction tempo information to calculate TR, which is an advance amount for matching TP and PP.

20. A system for audio waveform reproduction as recited in claim 11, wherein generation of the reproduction audio waveform is repeated from a start position of the stored audio waveform at a predetermined repetition period that is based on the reproduction tempo.

21. A method for audio waveform reproduction, the method comprising the steps of:

storing audio waveform data representing an original audio waveform;

entering reproduction tempo information representing a reproduction tempo;

generating first information (TP), TP representing both a time function based on the reproduction tempo information and a position on a common axis;

generating second information (PP), PP representing both a time function based on time axis compression/expansion information (TR) and a position on the common axis;

comparing TP and PP;

computing a new value for TR for matching temporal changes of PP to temporal changes of TP; and subjecting the stored audio waveform data to time axis compression/expansion processing based on TR to produce a reproduction audio waveform.

22. A method for audio waveform reproduction as recited in claim 21:

the stored audio waveform data comprising PCM data representing a time series of amplitude data sampled from the original audio waveform; and the method further including the step of performing time axis compression/expansion processing based on TR on the PCM data to produce the reproduction audio waveform.

23. A method for audio waveform reproduction as recited in claim 22, the common axis representing address positions of the PCM data.

24. A method for audio waveform reproduction as recited in claim 23, the reproduction tempo information comprising period information of a period corresponding to the reproduction tempo, the method further including the steps of:

storing original tempo information;

calculating an address change amount per a predetermined number of periods of the reproduction tempo information based on the original tempo information; and generating TP, which is a time function representing positions of the PCM data, based on the address change amount and the reproduction tempo information.

25. A method for audio waveform reproduction as recited in claim 24, the method further including the steps of:

calculating the address change amount per one period of the reproduction tempo information and generating TP, which is a time function representing positions of the PCM data that advances successively by the address change amount every time the reproduction tempo information is entered;

generating PP, which is a time function representing positions of the PCM data that advances successively by an amount equal to TR at each reproduction sampling period; and comparing TP and PP at each period of the reproduction tempo information to calculate TR, which is an advance amount for matching of TP and PP.

26. A method for audio waveform reproduction as recited in claim 21, the stored waveform data comprising analysis data representing the original audio waveform, the method further including the step of performing time axis compression/expansion processing based on TR on the analysis data to produce the reproduction audio waveform.

27. A method for audio waveform reproduction as recited in claim 26, the common axis representing virtual address positions on the time axis of the original audio waveform.

28. A method for audio waveform reproduction as recited in claim 27, the reproduction tempo information comprising period information of periods corresponding to the reproduction tempo, the method further including the steps of:

storing original tempo information;

calculating an address change amount per predetermined number of periods of the reproduction tempo information based on the original tempo information; and generating TP, which is a time function representing positions of the virtual addresses, based on the address change amount and the reproduction tempo information.

29. A method for audio waveform reproduction as recited in claim 28, the method further including the steps of:

calculating an address change amount per one period of the reproduction tempo information and generating TP, which is a time function representing positions of the virtual addresses that advance successively by the address change amount every time the reproduction tempo information is entered;

generating PP, which is a time function representing positions of the virtual addresses that advance successively by an amount equal to TR at each reproduction sampling period; and comparing TP and PP at each period of the reproduction tempo information to calculate TR, which is an advance amount for matching TP and PP.

30. A method for audio waveform reproduction as recited in claim 21, wherein generation of the reproduction audio waveform is repeated from a start position of the stored audio waveform at a predetermined repetition period that is based on the reproduction tempo.

31. A method for audio waveform reproduction as recited in claim 21, further including the step of multiplying TR by a tempo adjustment coefficient to produce a corrected value TR and an adjusted reproduction tempo.

* * * * *